US009921505B2

(12) United States Patent
Utsui et al.

(10) Patent No.: US 9,921,505 B2
(45) Date of Patent: Mar. 20, 2018

(54) TONER BINDER, AND TONER

(71) Applicant: SANYO CHEMICAL INDUSTRIES, LTD., Kyoto (JP)

(72) Inventors: Satoshi Utsui, Kyoto (JP); Tomohisa Kato, Kyoto (JP); Eiji Iwawaki, Kyoto (JP); Hiroshi Odajima, Kyoto (JP); Mana Sanpei, Kyoto (JP); Yuko Sugimoto, Kyoto (JP)

(73) Assignee: SANYO CHEMICAL INDUSTRIES, LTD., Kyoto (JP)

( * ) Notice: Subject to any disclaimer, the term of this patent is extended or adjusted under 35 U.S.C. 154(b) by 0 days.

(21) Appl. No.: 15/309,556

(22) PCT Filed: May 7, 2015

(86) PCT No.: PCT/JP2015/063212

§ 371 (c)(1),
(2) Date: Nov. 8, 2016

(87) PCT Pub. No.: WO2015/170705

PCT Pub. Date: Nov. 12, 2015

(65) Prior Publication Data

US 2017/0184990 A1 Jun. 29, 2017

(30) Foreign Application Priority Data

| | | |
|---|---|---|
| May 9, 2014 | (JP) | 2014-097863 |
| May 28, 2014 | (JP) | 2014-110538 |
| Sep. 5, 2014 | (JP) | 2014-180999 |
| Dec. 19, 2014 | (JP) | 2014-257151 |

(51) Int. Cl.

| | |
|---|---|
| ***G03G 9/08*** | (2006.01) |
| ***G03G 9/087*** | (2006.01) |
| ***G03G 9/09*** | (2006.01) |

(52) U.S. Cl.
CPC ..... *G03G 9/08755* (2013.01); *G03G 9/0819* (2013.01); *G03G 9/08797* (2013.01); *G03G 9/0904* (2013.01)

(58) Field of Classification Search
CPC ..... G03G 9/08755; G03G 9/08797
USPC ..... 430/109.4
See application file for complete search history.

(56) References Cited

U.S. PATENT DOCUMENTS

| | | | | |
|---|---|---|---|---|
| 9,477,165 | B2 * | 10/2016 | Miyaake | G03G 9/08733 |
| 9,696,645 | B2 * | 7/2017 | Mine | G03G 9/08797 |
| 2006/0204880 | A1 * | 9/2006 | Mizutani | G03G 9/0806 430/109.4 |
| 2013/0337374 | A1 | 12/2013 | Sugimoto et al. | |
| 2015/0024322 | A1 | 1/2015 | Sugimoto et al. | |

FOREIGN PATENT DOCUMENTS

| | | |
|---|---|---|
| JP | 7-199534 | 8/1995 |
| JP | 2004-133322 | 4/2004 |
| JP | 2005-77930 | 3/2005 |
| JP | 2005-308995 | 11/2005 |
| JP | 2006-251564 | 9/2006 |
| JP | 2007-292816 | 11/2007 |
| JP | 2011-186053 | 9/2011 |
| JP | 2011-197192 | 10/2011 |
| JP | 2011-197193 | 10/2011 |
| JP | 2011-197659 | 10/2011 |
| JP | 2012-8371 | 1/2012 |
| JP | 2012-98719 | 5/2012 |
| JP | 2013-178504 | 9/2013 |
| JP | 2013-228707 | 11/2013 |
| JP | 2013-228724 | 11/2013 |
| JP | 2014-2244 | 1/2014 |
| WO | 2013/128872 | 9/2013 |
| WO | 2014/034963 | 3/2014 |
| WO | 2014/046067 | 3/2014 |

OTHER PUBLICATIONS

International Search Report dated Jun. 16, 2015 in corresponding International Application No. PCT/JP2015/063212.

* cited by examiner

*Primary Examiner* — Mark A Chapman
(74) *Attorney, Agent, or Firm* — Wenderoth, Lind & Ponack, L.L.P.

(57) ABSTRACT

The toner binder of the present invention contains a crystalline resin (A) and a resin (B) that is a polyester resin or its modified resin, the polyester resin being obtained by reaction of an alcohol component (X) and a carboxylic acid component (Y) as raw materials, wherein a temperature (Tp) of the top of an endothermic peak derived from the crystalline resin (A) as measured by a differential scanning calorimeter (DSC) is in the range of 40° C. to 100° C., and endothermic peak areas $S_1$ and $S_2$ during heating satisfy the following equation.

$$(S_2/S_1)\times 100 \geq 35 \quad (1)$$

$S_1$ is an area of the endothermic peak derived from the crystalline resin (A) in the first heating process, and $S_2$ is an area of the endothermic peak derived from the crystalline resin (A) in the second heating process, when the toner binder is heated, cooled, and heated.

16 Claims, No Drawings

TONER BINDER, AND TONER

TECHNICAL FIELD

The present invention relates to a toner for use in development of electrostatic images or magnetic latent images by methods such as an electrographic method, an electrostatic recording method and an electrostatic printing method, and a toner binder contained in the toner.

BACKGROUND ART

Along with recent advancements in smaller and higher speed electrophotographic devices with higher image quality, there is a strong demand for improving low-temperature fixability of the toner in view of energy saving by reducing the amount of energy consumption in a fixing step.

Usually, a method that reduces the glass transition temperature of a binding resin is used to reduce the fixing temperature of the toner.

However, if the glass transition temperature is reduced too much, the hot offset resistance will be reduced and aggregation of powder (i.e., "blocking") will easily occur, thus reducing the storage stability of the toner. Therefore, the practical lower limit of the glass transition temperature is 50° C. The glass transition temperature is a design point of the binding resin, and the method that reduces the glass transition temperature cannot provide a toner that can be fixed at even lower temperatures.

Patent Literatures 1 and 2 disclose toner compositions containing a polyester-based toner binder. These toner compositions are excellent in low-temperature fixability and hot offset resistance. Yet, a recent demand to ensure storage stability and maintain the balance between low-temperature fixability and hot offset resistance (fixing temperature range) is further increasing, and the above toner compositions are yet to meet the demand.

In another method, a combination of an amorphous resin and a crystalline resin is used for a binding resin. It is known that such a combination improves the low-temperature fixability and gloss of the toner due to the melt characteristics of the crystalline resin.

Yet, in some cases, a higher crystalline resin content reduces the resin strength, and the crystalline resin becomes amorphous during melt-kneading due to miscibility between the crystalline resin and the binding resin, resulting in a decrease in the glass transition temperature of the toner, thus causing the same problems as mentioned above.

Some methods are suggested as countermeasures to the above problems. For example, Patent Literature 3 discloses a method for recrystallizing the crystalline resin by a heat treatment after a melt-kneading step, and Patent Literatures 4 and 5 each disclose a method in which different monomer components are used.

With the above methods, it is possible to ensure low-temperature fixability and gloss of the toner; however, properties such as hot offset resistance, toner flowability, and heat-resistant storage stability (i.e., stability during storage at high temperatures) are insufficient. These methods are also faced with problems such as a decrease in electrostatic stability and grindability during grinding.

Patent Literatures 6 to 9 each suggest a method in which the core is encapsulated by a shell layer obtained by a melt suspension method or an emulsification aggregation method. Yet, the crystalline resin is miscible with the binding resin as the core, and the crystals cannot be sufficiently re-precipitated in a short time. Thus, it is still not possible to provide sufficient image strength after fixing or sufficient folding resistance.

In addition, Patent Literature 10 discloses a method in which a crystalline resin is added to a styrene-acrylic based amorphous resin, and crystal precipitation is induced by immiscibility between the amorphous resin and the crystalline resin. Yet, since the amorphous resin is a styrene acrylic resin, the resulting toner has sufficient low-temperature fixability.

CITATION LIST

Patent Literature

Patent Literature 1: JP-A 2005-77930
Patent Literature 2: JP-A 2012-98719
Patent Literature 3: JP-A 2005-308995
Patent Literature 4: JP-A 2012-8371
Patent Literature 5: JP-A 2007-292816
Patent Literature 6: JP-A 2011-197193
Patent Literature 7: JP-A 2011-197192
Patent Literature 8: JP-A 2011-186053
Patent Literature 9: JP-A 2006-251564
Patent Literature 10: JP-A 2011-197659

SUMMARY OF INVENTION

Technical Problem

The present invention aims to provide a toner and a toner binder provided therein. The toner binder provides excellent flowability, excellent heat-resistant storage stability, electrostatic stability, grindability, image strength, folding resistance and document offset resistance while maintaining the balance among hot offset resistance, low-temperature fixability, and gloss.

Solution to Problem

As a result of extensive examinations to solve the problems, the present inventors reached the present invention.

Specifically, the present invention provides a toner binder containing a crystalline resin (A) and a resin (B) that is a polyester resin or its modified resin, the polyester resin being obtained by reaction of an alcohol component (X) and a carboxylic acid component (Y) as raw materials, wherein a temperature (Tp) of a top of an endothermic peak derived from the crystalline resin (A) as measured by a differential scanning calorimeter (DSC) is in the range of 40° C. to 100° C., and endothermic peak areas $S_1$ and $S_2$ during heating satisfy the following equation (1).

$$(S_2/S_1)\times 100 \geq 35 \quad (1)$$

$S_1$ is an area of the endothermic peak derived from the crystalline resin (A) in the first heating process, and $S_2$ is an area of the endothermic peak derived from the crystalline resin (A) in the second heating process, when the toner binder is heated, cooled, and heated.

Advantageous Effects of Invention

According to the present invention, it is possible to provide a toner and a toner binder contained therein, wherein the toner binder provides excellent flowability, heat-resistant storage stability, electrostatic stability, grindability, image strength, folding resistance, and document offset resistance while maintaining the balance among hot offset resistance, low-temperature fixability, and gloss.

DESCRIPTION OF EMBODIMENTS

The present invention is described in detail below.

The toner binder of the present invention contains a crystalline resin (A) and a resin (B) that is a polyester resin or its modified resin, the polyester resin being obtained by reaction of an alcohol component (X) and a carboxylic acid component (Y) as raw materials, wherein a temperature (Tp) of a top of an endothermic peak derived from the crystalline resin (A) as measured by a differential scanning calorimeter (DSC) is in the range of 40° C. to 100° C., and endothermic peak areas $S_1$ and $S_2$ during heating satisfy the following equation (1):

$$(S_2/S_1)\times 100 \geq 35 \quad (1)$$

In the present invention, $S_1$ is an area of the endothermic peak derived from the crystalline resin (A) in the first heating process, and $S_2$ is an area of the endothermic peak derived from the crystalline resin (A) in the second heating process, when the toner binder is heated, cooled, and heated. The area of the endothermic peak derived from the crystalline resin (A) is measured by a DSC. As used herein, the resin (B) that is a polyester resin or its modified resin, the polyester resin being obtained by reaction of the alcohol component (X) and the carboxylic acid component (Y) as raw materials, is also referred to as a "resin (B)".

The toner binder of the present invention contains the crystalline resin (A) and the resin (B) as essential components. When the toner binder of the present invention is heated, cooled, and heated under given conditions, the toner exhibits two or more endothermic peaks as measured by a differential scanning calorimeter (DSC), as will be described later.

Provided that the area of the endothermic peak derived from the crystalline resin (A) in the first heating process is regarded as $S_1$ and the area of the endothermic peak derived from the crystalline resin (A) in the second heating process is regarded as $S_2$, which are measured by a DSC, when the toner binder is heated, cooled, and heated, the toner binder exhibits the temperature (Tp) of a top of an endothermic peak derived from the crystalline resin (A) at least once in the range of 40° C. to 100° C., and the endothermic peak areas $S_1$ and $S_2$ during heating satisfy the following equation (1):

$$(S_2/S_1)\times 100 \geq 35 \quad (1).$$

In the present invention, the heating and cooling conditions for DSC measurement are as follows: heating from 30° C. to 180° C. at a rate of 10° C./rain (first heating process); after leaving to stand at 180° C. for 10 minutes, cooling to 0° C. at a rate of 10° C./min (first cooling process); and after leaving to stand at 0° C. for 10 minutes, heating to 180° C. at a rate of 10° C./rain (second heating process).

The endothermic peak areas $S_1$ and $S_2$ of the toner binder of the present invention satisfy the above equation (1), wherein $S_1$ is the area of the endothermic peak derived from the crystalline resin (A) in the first heating process and $S_2$ is the area of the endothermic peak derived from the crystalline resin (A) in the second heating process, as measured by a DSC, when the toner binder is heated, cooled, and heated under the conditions mentioned above.

When there are two or more endothermic peaks derived from the crystalline resin (A) for $S_1$ and $S_2$, these peaks are added up for $S_1$ and $S_2$ for calculation.

In addition, when the endothermic peak derived from the crystalline resin (A) overlaps an endothermic peak not derived from the crystalline resin (A), these peaks are decomposed to determine the area of the endothermic peak derived from the crystalline resin (A). Crystalline materials such as wax among other materials to be further added to the toner binder may show an endothermic peak in some cases.

The area of the endothermic peak is calculated by drawing a line perpendicular to the baseline at a saddle to divide peaks and using the areas obtained by dividing the peaks with the parting line.

The toner instead of the toner binder may be used for DSC measurement as long as the peaks can be identified.

In the assay in which the toner and the toner binder of the present invention is heated, cooled, and heated under the conditions mentioned above, the first heating process is considered to correspond to a heat fixing step, and the second heating process is considered to correspond to a treatment to impart thermal stability to a fixed image obtained in the heat fixing step.

Specifically, when the equation (1) is satisfied, in the heat fixing step corresponding to the first heating process, a portion of the crystalline resin (A) becomes miscible with the resin (B) and the toner is plasticized, thus allowing an image to be fixed at a low temperature. After cooling, the crystalline resin (A) is recrystallized, which increases the Tg and viscosity, thus improving the thermal stability of the fixed image.

A decrease in the Tg after melt-kneading can also be suppressed due to the same phenomenon, and a toner can be produced without special steps such as those disclosed in Patent Literatures 1 to 6.

The value of the left-hand side of the equation (1) is 35 or more, preferably 40 to 99, more preferably 50 to 98, in view of the toner low-temperature fixability, flowability, heat-resistant storage stability, grindability, image strength after fixing, folding resistance, and document offset resistance.

The range of the temperature Tp (° C.) of the top of the endothermic peak derived from the crystalline resin (A) is 40° C. to 100° C., preferably 45° C. to 95° C., more preferably 50 to 90° C.

The term "temperature of top of an endothermic peak" refers to the temperature at the lowest point of the negative endothermic peak.

When there are two or more endothermic peaks derived from the crystalline resin (A), it suffices as long as the temperature of the top of at least one endothermic peak is in the above range.

The temperature Tp is 40° C. or higher in view of toner flowability, heat-resistant storage stability, grindability, image strength after fixing, folding resistance, and document offset resistance, and is 100° C. or lower in view of low-temperature fixability and gloss.

The temperature Tp (° C.) of the top of the endothermic peak derived from the crystalline resin (A) in the present invention is determined from the endothermic peak derived from the crystalline resin (A) in the second heating process as determined by a DSC, when the toner binder is heated, cooled, and heated under the conditions mentioned above.

The temperature Tp (° C.) of the top of the endothermic peak derived from the crystalline resin (A) in the present invention can also be determined from the endothermic peak of the crystalline resin (A) in the second heating process as determined by a DSC when the crystalline resin (A) is used instead of the toner binder, and then the crystalline resin (A) is heated, cooled, and heated under the conditions mentioned above. The temperature Tp (° C.) of the top of the endothermic peak derived from the crystalline resin (A) measured using the toner binder by the above method is usually the same as the temperature Tp (° C.) of the top of the endothermic peak determined from the endothermic peak of the crystalline resin (A) using the crystalline resin (A) by the above method.

The endothermic capacity (J/g) derived from the crystalline resin (A) in the second heating process is usually preferably 1 to 30 J/g, more preferably 2 to 25 J/g, still more preferably 3 to 20 J/g. The endothermic capacity derived from the crystalline resin (A) is preferably 1 J/g or more in view of low-temperature fixability and gloss, and is preferably 30 J/g or less in view of hot melt resistance. The endothermic capacity derived from the crystalline resin (A) in the heating process is measured by a DSC.

The crystalline resin (A) used in the present invention is not particularly limited as long as it has crystalline properties, a temperature Tp in the above range, and satisfies the equation (1).

The term "crystalline resin" as used herein refers to a resin that exhibits a clear endothermic peak, not a stepwise endothermic change, in the first heating process as measured by a DSC as described above.

Further, the crystalline resin (A) is preferably a resin having at least two chemically bonded segments including a crystalline segment (a1) miscible with the resin (B) and a segment (a2) immiscible with the resin (B). As used herein, the crystalline segment (a1) miscible with the resin (B) is also simply referred to as "segment (a1)" or "crystalline segment (a1)". The segment (a2) immiscible with the resin (B) is also simply referred to as "segment (a2)".

In the present invention, the phrase "immiscible with the resin (B)" means that when a mixture obtained by mixing the resin (B) with compounds constituting the segments is visually observed at room temperature, the mixture is wholly or partially turbid.

The method for mixing the resin (B) with compounds constituting the segments is not particularly limited. Examples include a method in which the resin (B) is mixed with compounds constituting the segments using a melt-kneader, a method in which these components are dissolved in a solvent or the like to be mixed and the solvent is removed afterwards, and a method in which the resin (B) is mixed with compounds constituting the segments during production of the resin (B). The mixing temperature is preferably 100° C. to 200° C., more preferably 110° C. to 190° C., in view of resin viscosity.

The segment (a1) may have any chemical structure as long as it has crystalline properties and miscible with the resin (B). Examples of structures include those formed of the following compounds such as a crystalline polyester (a11), a crystalline polyurethane (a12), a crystalline polyurea (a13), a crystalline polyamide (a14), and a crystalline polyvinyl (a15). The segment (a1) preferably has a structure formed of any of these compounds.

Crystalline Polyester (a11)

The crystalline polyester (a11) that can be used as the crystalline segment (a1) may have any chemical structure as long as it is miscible with the resin (B).

The crystalline polyester (a11) is preferably a polyester resin obtainable by reaction of the diol component (x) and a dicarboxylic acid component (y) as raw materials. A tri- or higher hydric alcohol component or a tri- or higher valent polycarboxylic acid component may be optionally used in combination with the diol component (x) and a dicarboxylic acid component (y).

Examples of diols as the diol component (x) include aliphatic diols; C4-C36 alkylene ether glycols (e.g., diethylene glycol, triethylene glycol, dipropylene glycol, polyethylene glycol, polypropylene glycol, and polytetramethylene ether glycol); C4-C36 alicyclic diols (e.g., 1,4-cyclohexane dimethanol, and hydrogenated bisphenol A); alkylene oxide (hereinafter abbreviated to "AO") adducts (addition molar number: 1 to 30) of the above alicyclic diols (e.g., ethylene oxide (hereinafter abbreviated to "EO") adduct, propylene oxide (hereinafter abbreviated to "PO") adduct, and butylene oxide (hereinafter abbreviated to "BO") adduct (addition molar number: 1 to 30) of the above alicyclic diols); bisphenol (e.g., bisphenol A, bisphenol F, or bisphenol S) AO (e.g., EO, PO, or BO) adducts (addition molar number: 2 to 30); polylactone diols (e.g., poly(ε-caprolactone) diol); and polybutadiene diols. Two or more of these may be used in combination.

Preferred among these diols are aliphatic diols in view of crystallinity. The carbon number is usually in the range of 2 to 36, preferably 2 to 20. Further, linear aliphatic diols are more preferred than branched aliphatic diols from the same view point.

Examples of the linear aliphatic diols include C2-C20 alkylene glycols such as ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,20-eicosanediol. Preferred among these are ethylene glycol, 1,3-propanediol, 1,4-butanediol, 1,6-hexanediol, 1,9-nonanediol, 1,10-decanediol, and 1,12-dodecanediol.

In view of crystallinity, the linear aliphatic diol content preferably accounts for 80% by mole or more, more preferably 90% by mole or more, of the diol component (x) used.

Examples of tri- or higher hydric alcohol components include tri- or higher polyols, specifically, tri- to octanol or higher polyols.

Examples of tri- to octanol or higher polyols to be optionally used in combination with the diol component (x) include C3-C36 tri- to octahydric or higher hydric aliphatic alcohols (alkane polyols and intramolecular or intermolecular dehydration products thereof, e.g., glycerol, trimethylolethane, trimethylolpropane, pentaerythritol, sorbitol, sorbitan, and polyglycerol; sugars and derivatives thereof, e.g., sucrose and methyl glucoside); trisphenol (e.g., trisphenol PA) AO adducts (addition molar number: 2 to 30); novolak resin AO adducts (addition molar number: 2 to 30) (e.g., phenol novolak and cresol novolak); and acrylic polyols (e.g., a copolymer of hydroxyethyl (meth)acrylate and another vinyl monomer).

Preferred among these are tri- to octahydric or higher hydric aliphatic alcohols and novolak resin AO adducts, with novolak resin AO adducts being more preferred.

The crystalline polyester (a11) may have a structural unit derived from a diol (x') in addition to the diol component (x). The diol (x') has at least one group selected from the group consisting of a carboxylic acid (salt) group, a sulfonic acid (salt) group, a sulfamic acid (salt) group, and a phosphoric acid (salt) group.

The crystalline polyester (a11) having a structural unit derived from the diol (x') having at least one of these functional groups improves electrostatic properties and heat-resistant storage stability of the toner.

The term "acid (salt)" as used herein refers to an acid or an acid salt.

A polyester resin obtained by reaction of the diol component (x), the diol (x') having a functional group, and the dicarboxylic acid component (y) as raw materials is preferred as the crystalline polyester (a11). The diol (x') having a functional group may be used alone, or two or more thereof may be used in combination.

Examples of the diol (x') having a carboxylic acid (salt) group include tartaric acid (salt), 2,2-bis(hydroxymethyl) propanoic acid (salt), 2,2-bis(hydroxymethyl)butanoic acid (salt), and 3-[bis(2-hydroxyethyl)amino]propanoic acid (salt).

Examples of the diol (x') having a sulfonic acid (salt) group include 2,2-bis(hydroxymethyl)ethanesulfonic acid (salt), 2-[bis(2-hydroxyethyl)amino]ethanesulfonic acid (salt), and 5-sulfo-isophthalic acid-1,3-bis(2-hydroxyethyl) ester (salt).

Examples of the diol (x') having a sulfamic acid (salt) group include N,N-bis(2-hydroxyethyl)sulfamic acid (salt), N,N-bis(3-hydroxypropyl)sulfamic acid (salt), N,N-bis(4-hydroxybutyl)sulfamic acid (salt), and N,N-bis(2-hydroxypropyl)sulfamic acid (salt).

Examples of the diol (x') having a phosphoric acid (salt) group include bis(2-hydroxyethyl)phosphate (salt).

Examples of salts forming acid salts include ammonium salts, amine salts (e.g., methylamine salt, dimethylamine salt, trimethylamine salt, ethylamine salt, diethylamine salt, triethylamine salt, propylamine salt, dipropylamine salt, tripropylamine salt, butylamine salt, dibutylamine salt, tributylamine salt, monoethanolamine salt, diethanolamine salt, triethanolamine salt, N-methylethanolamine salt, N-ethylethanolamine salt, N,N-dimethylethanolamine salt, N,N-diethylethanolamine salt, hydroxylamine salt, N,N-diethylhydroxylamine salt, and morpholine salt), quaternary ammonium salts (e.g., tetramethyl ammonium salt, tetraethyl ammonium salt, and trimethyl(2-hydroxyethyl)ammonium salt), and alkali metal salts (e.g., sodium salt and potassium salt).

Preferred among these diols (x') having a functional group are the diols (x') having a carboxylic acid (salt) group and the diols (x') having a sulfonic acid (salt) group in view of electrostatic properties and heat-resistant storage stability of the toner.

Examples of dicarboxylic acids as the dicarboxylic acid component (y) constituting the crystalline polyester (a11) include C2-C50 (including a carbon atom of a carbonyl group) alkane dicarboxylic acids (e.g., succinic acid, adipic acid, sebacic acid, azelaic acid, and dodecane dicarboxylic acids (such as dodecanedioic acid, octadecane dicarboxylic acid, and decyl succinic acid)); C4-C50 alkene dicarboxylic acids (e.g., alkenyl succinic acids (such as dodecenyl succinic acid, pentadecenyl succinic acid, and octadecenyl succinic acid), maleic acid, fumaric acid, and citraconic acid); C6-C40 alicyclic dicarboxylic acids (e.g., dimer acid (dimerized linoleic acid)); and C8-C36 aromatic dicarboxylic acids (e.g., phthalic acid, isophthalic acid, terephthalic acid, t-butylisophthalic acid, 2,6-naphthalenedicarboxylic acid, and 4,4'-biphenyldicarboxylic acid). Two or more of these dicarboxylic acids may be used in combination.

Preferred among these dicarboxylic acids are aliphatic dicarboxylic acids such as alkane dicarboxylic acid and alkene dicarboxylic acid in view of crystallinity, with aliphatic dicarboxylic acids such as C2-C50 alkane dicarboxylic acids and C4-C50 alkene dicarboxylic acids being more preferred, and linear dicarboxylic acids being particularly preferred. For example, adipic acid, sebacic acid, dodecanedioic acid, and the like are particularly preferred.

In addition, copolymers of aliphatic dicarboxylic acids and aromatic dicarboxylic acids (e.g., terephthalic acid, isophthalic acid, t-butylisophthalic acid, and lower alkyl esters of these acids) are similarly preferred. The amount of an aromatic dicarboxylic acid to form a copolymer is preferably 20% by mole or less.

In the production of the crystalline polyester (a11), examples of the tri- or higher valent polycarboxylic acid component that is optionally used include tri- to hexavalent or higher valent polycarboxylic acids. Examples of tri- to hexavalent or higher valent polycarboxylic acids include C9-C20 aromatic polycarboxylic acids (e.g., trimellitic acid and pyromellitic acid), C6-C36 aliphatic tricarboxylic acids (e.g., hexanetricarboxylic acid), vinyl polymers of unsaturated carboxylic acids [number average molecular weight (Mn): 450 to 10,000] (e.g., styrene/maleic acid copolymer, styrene/acrylic acid copolymer, and styrene/fumaric acid copolymer). The number average molecular weight (Mn) is determined by gel permeation chromatography (GPC).

The dicarboxylic acid or the tri- to hexavalent or higher valent polycarboxylic acid may be an acid anhydride of any of those mentioned above or a C1-C4 lower alkyl ester (e.g., methyl ester, ethyl ester, and isopropyl ester).

Crystalline Polyurethane (a12)

The crystalline polyurethane (a12) that can be used as the crystalline segment (a1) may have any chemical structure as long as it is miscible with the resin (B).

Examples of the crystalline polyurethane (a12) include one having structural units derived from the crystalline polyester (a11) and a diisocyanate (v2), and one having structural units derived from the crystalline polyester (a11), the diol component (x), and the diisocyanate (v2).

The crystalline polyurethane (a12) having structural units derived from the crystalline polyester (a11) and the diisocyanate (v2) is obtainable by reaction of the crystalline polyester (a11) and the diisocyanate (v2). The crystalline polyurethane (a12) having structural units derived from the crystalline polyester (a11), the diol component (x), and the diisocyanate (v2) is obtainable by reaction of the crystalline polyester (a11), the diol component (x), and the diisocyanate (v2).

In the case where the crystalline polyurethane (a12) has a structural unit derived from the diol (x') having at least one of the functional groups together with the diol component (x), the electrostatic properties and heat-resistant storage stability of the toner will be improved.

Examples of the diisocyanate (v2) include C6-C20 (excluding a carbon atom in an NCO group, hereinafter the same) aromatic diisocyanates, C2-C18 aliphatic diisocyanates, modified products of these diisocyanates (modified products containing a urethane group, a carbodiimide group, an allophanate group, a urea group, a biuret group, a uretdione group, a uretimine group, an isocyanurate group, an oxazolidone group, or the like), and mixtures of two or more thereof.

Examples of the C6-C20 aromatic diisocyanates include 1,3- or 1,4-phenylene diisocyanate, 2,4- or 2,6-tolylene diisocyanate (TDI), crude TDI, m- or p-xylylene diisocyanate (XDI), α,α,α',α'-tetramethylxylylene diisocyanate (TMXDI), 2,4'- or 4,4'-diphenylmethane diisocyanate (MDI), and crude diaminophenylmethane diisocyanate (crude MDI).

Examples of the C2-C18 aliphatic diisocyanates include C2-C18 acyclic aliphatic diisocyanates and C3-C18 cyclic aliphatic diisocyanates.

Examples of the C2-C18 acyclic aliphatic diisocyanates include ethylene diisocyanate, tetramethylene diisocyanate, hexamethylene diisocyanate (HDI), dodecamethylene diisocyanate, 2,2,4-trimethyl hexamethylene diisocyanate, lysine diisocyanate, 2,6-diisocyanato methylcaproate, bis(2-isocyanatoethyl)fumarate, bis(2-isocyanatoethyl)carbonate, 2-isocyanatoethyl-2,6-diisocyanatohexanoate, and mixtures thereof.

Examples of the C3-C18 cyclic aliphatic diisocyanates include isophorone diisocyanate (IPDI), dicyclohexylmethane-4,4'-diisocyanate (hydrogenated MDI), cyclohexylene diisocyanate, methylcyclohexylene diisocyanate (hydrogenated TDI), bis(2-isocyanatoethyl)-4-cyclohexene-1,2-dicarboxylate, 2,5- or 2,6-norbornane diisocyanate, and mixtures thereof.

Examples of modified products of diisocyanates include modified products containing at least one of a urethane group, a carbodiimide group, an allophanate group, a urea group, a biuret group, a uretdione group, a uretimine group, an isocyanurate group, or an oxazolidone group. Examples include modified MDI (e.g., urethane-modified MDI, carbodiimide-modified MDI, and trihydrocarbyl phosphate-modified MDI), urethane-modified TDI, and mixtures thereof (e.g., a mixture of modified MDI and urethane-modified TDI (isocyanate-containing prepolymer)).

Preferred among these diisocyanates (v2) are C6-C15 aromatic diisocyanates and C4-C15 aliphatic diisocyanates. TDI, MDI, HDI, hydrogenated MDI, and IPDI are more preferred.

Crystalline Polyurea (a13)

The crystalline polyurea (a13) that can be used as the crystalline segment (a1) may have any chemical structure as long as it is miscible with the resin (B).

Examples of the crystalline polyurea (a13) include one having structural units derived from the crystalline polyester (a11), a diamine (z), and the diisocyanate (v2). The crystalline polyurea (a13) is obtainable by reaction of the crystalline polyester (a11), the diamine (z), and the diisocyanate (v2).

Examples of the diamine (z) include C2-C18 aliphatic diamines and C6-C20 aromatic diamines.

Examples of the C2-C18 aliphatic diamines include acyclic aliphatic diamines and cyclic aliphatic diamines.

Examples of the acyclic aliphatic diamines include C2-C12 alkylene diamines (e.g., ethylenediamine, propylenediamine, trimethylenediamine, tetramethylenediamine, and hexamethylenediamine) and polyalkylene (C2-C6) polyamines (e.g., diethylenetriamine, iminobispropylamine, bis(hexamethylene)triamine, triethylenetetramine, tetraethylenepentamine, and pentaethylenehexamine).

Examples of the cyclic aliphatic polyamines include C4-C15 alicyclic diamines (e.g., 1,3-diaminocyclohexane, isophoronediamine, menthanediamine, 4,4'-methylenedicyclohexanediamine (hydrogenated methylenedianiline), and 3,9-bis(3-aminopropyl)-2,4,8,10-tetraoxaspiro[5,5]undecane), and C4-C15 heterocyclic diamines (e.g., piperazine, N-aminoethylpiperazine, 1,4-diaminoethylpiperazine, and 1,4-bis(2-amino-2-methylpropyl)piperazine).

Examples of the C6-C20 aromatic diamines include unsubstituted aromatic diamines and aromatic diamines having an alkyl group (a C1-C4 alkyl group such as a methyl group, an ethyl group, an n- or isopropyl group, or a butyl group).

Examples of the unsubstituted aromatic diamines include 1,2-, 1,3- or 1,4-phenylenediamine, 2,4'- or 4,4'-diphenylmethanediamine, diaminodiphenylsulfone, benzidine, thiodianiline, bis(3,4-diaminophenyl)sulfone, 2,6-diaminopyridine, m-aminobenzylamine, naphthalenediamine, and mixtures thereof.

Examples of aromatic diamines having an alkyl group (a C1-C4 alkyl group such as a methyl group, an ethyl group, an n- or isopropyl group, or a butyl group) include 2,4- or 2,6-tolylene diamine, crude tolylene diamine, diethyltolylene diamine, 4,4'-diamino-3,3'-dimethyldiphenylmethane, 4,4'-bis(o-toluidine), dianisidine, diaminoditolylsulfone, 1,3-dimethyl-2,4-diaminobenzene, 1,3-diethyl-2,4-diaminobenzene, 1,3-dimethyl-2,6-diaminobenzene, 1,4-diethyl-2,5-diaminobenzene, 1,4-diisopropyl-2,5-diaminobenzene, 1,4-dibutyl-2,5-diaminobenzene, 2,4-diaminomesitylene, 1,3,5-triethyl-2,4-diaminobenzene, 1,3,5-triisopropyl-2,4-diaminobenzene, 1-methyl-3,5-diethyl-2,4-diaminobenzene, 1-methyl-3,5 diethyl-2,6-diaminobenzene, 2,3-dimethyl-1,4-diaminonaphthalene, 2,6-dimethyl-1,5-diaminonaphthalene, 2,6-diisopropyl-1,5-diaminonaphthalene, 2,6-dibutyl-1,5-diaminonaphthalene, 3,3',5,5'-tetramethylbenzidine, 3,3',5,5'-tetraisopropylbenzidine, 3,3',5,5'-tetramethyl-4,4'-diaminodiphenylmethane, 3,3',5,5'-tetraethyl-4,4'-diaminodiphenylmethane, 3,3',5,5'-tetraisopropyl-4,4'-diaminodiphenylmethane, 3,3',5,5'-tetrabutyl-4,4'-diaminodiphenylmethane, 3,5-diethyl-3'-methyl-2',4-diaminodiphenylmethane, 3,5-diisopropyl-3'-methyl-2',4-diaminodiphenylmethane, 3,3'-diethyl-2,2'-diaminodiphenylmethane, 4,4'-diamino-3,3'-dimethyldiphenylmethane, 3,3',5,5'-tetraethyl-4,4'-diaminobenzophenone, 3,3',5,5'-tetraisopropyl-4,4'-diaminobenzophenone, 3,3',5,5'-tetraethyl-4,4'-diaminodiphenylether, 3,3',5,5'-tetraisopropyl-4,4'-diaminodiphenylsulfone, and mixtures thereof.

Examples of the diisocyanate (v2) include C6-C20 (excluding a carbon atom in an NCO group, hereinafter the same) aromatic diisocyanates, C2-C18 aliphatic diisocyanates, modified products of these diisocyanates (modified products containing a urethane group, a carbodiimide group, an allophanate group, a urea group, a biuret group, a uretdione group, a uretimine group, an isocyanurate group, an oxazolidone group, or the like), and mixtures of two or more thereof.

Examples of the C6-C20 aromatic diisocyanates include 1,3- or 1,4-phenylene diisocyanate, 2,4- or 2,6-tolylene diisocyanate (TDI), crude TDI, m- or p-xylylene diisocyanate (XDI), α,α,α',α'-tetramethylxylylene diisocyanate (TMXDI), 2,4'- or 4,4'-diphenylmethane diisocyanate (MDI), and crude diaminophenylmethane diisocyanate (crude MDI).

Examples of the C2-C18 aliphatic diisocyanates include C2-C18 acyclic aliphatic diisocyanates and C3-C18 cyclic aliphatic diisocyanates.

Examples of the C2-C18 acyclic aliphatic diisocyanates include ethylene diisocyanate, tetramethylene diisocyanate, hexamethylene diisocyanate (HDI), dodecamethylene diisocyanate, 2,2,4-trimethyl hexamethylene diisocyanate, lysine diisocyanate, 2,6-diisocyanato methylcaproate, bis(2-isocyanatoethyl)fumarate, bis(2-isocyanatoethyl) carbonate, 2-isocyanatoethyl-2,6-diisocyanatohexanoate, and mixtures thereof.

Examples of the C3-C18 cyclic aliphatic diisocyanates include isophorone diisocyanate (IPDI), dicyclohexylmethane-4,4'-diisocyanate (hydrogenated MDI), cyclohexylene diisocyanate, methylcyclohexylene diisocyanate (hydrogenated TDI), bis(2-isocyanatoethyl)-4-cyclohexene-1,2-dicarboxylate, 2,5- or 2,6-norbornane diisocyanate, and mixtures thereof.

Examples of modified products of diisocyanates include modified products containing at least one of a urethane group, a carbodiimide group, an allophanate group, a urea group, a biuret group, a uretdione group, a uretimine group, an isocyanurate group, or an oxazolidone group. Examples include modified MDI (e.g., urethane-modified MDI, carbodiimide-modified MDI, and trihydrocarbyl phosphate-modified MDI), urethane-modified TDI, and mixtures thereof (e.g., a mixture of modified MDI and urethane-modified TDI (isocyanate-containing prepolymer)).

Preferred among these diisocyanates (v2) are C6-C15 aromatic diisocyanates and C4-C15 aliphatic diisocyanates. TDI, MDI, HDI, hydrogenated MDI, and IPDI are more preferred.

Crystalline Polyamide (a14)

The crystalline polyamide (a14) that can be used as the crystalline segment (a1) may have any chemical structure as long as it is miscible with the resin (B).

Examples of the crystalline polyamide (a14) include one having structural units derived from the crystalline polyester (a11), the diamine (z), and the dicarboxylic acid component (y). The crystalline polyamide (a14) is obtainable by reaction of the crystalline polyester (a11), the diamine (z), and the dicarboxylic acid component (y).

Crystalline Polyvinyl Resin (a15)

The crystalline polyvinyl resin (a15) that can be used as the crystalline segment (a1) may have any chemical structure as long as it is miscible with the resin (B).

Examples of the crystalline polyvinyl resin (a15) include polymers obtained by homopolymerization or copolymerization of an ester having a polymerizable double bond.

Examples of esters having a polymerizable double bond include vinyl acetate, vinyl propionate, vinyl butyrate, diallyl phthalate, diallyl adipate, isopropenyl acetate, vinyl methacrylate, methyl-4-vinyl benzoate, cyclohexyl methacrylate, benzyl methacrylate, phenyl (meth)acrylate, vinyl methoxy acetate, vinyl benzoate, ethyl-α-ethoxy acrylate, C1-C50 alkyl group-containing alkyl (meth)acrylate (e.g., methyl (meth)acrylate, ethyl (meth)acrylate, propyl (meth) acrylate, butyl (meth)acrylate, 2-ethylhexyl (meth)acrylate, dodecyl (meth)acrylate, hexadecyl (meth)acrylate, heptadecyl (meth)acrylate, and eicosyl (meth)acrylate), dialkyl fumarate (two alkyl groups are each a C2-C8 linear, branched, or alicyclic group), dialkyl maleate (two alkyl groups are each a C2-C8 linear, branched, or alicyclic group), poly(meth)allyloxy alkanes (e.g., diallyloxyethane, triallyloxyethane, tetraallyloxyethane, tetraallyloxypropane, tetraallyloxybutane, and tetramethallyloxyethane), monomers having a polyalkylene glycol chain and a polymerizable double bond (e.g., polyethylene glycol (Mn=300) mono (meth)acrylate, polypropylene glycol (Mn=500) monoacrylate, methyl alcohol EO (10 mol) adduct (meth) acrylate, and lauryl alcohol EO (30 mol) adduct (meth) acrylate), poly(meth)acrylates (e.g., polyhydric alcohol poly (meth)acrylates such as ethylene glycol di(meth)acrylate, propylene glycol di(meth)acrylate, neopentyl glycol di(meth)acrylate, trimethylolpropane tri(meth)acrylate, and polyethylene glycol di(meth)acrylate).

The crystalline polyvinyl resin (a15) may have compounds such as the following monomers (w1) to (w9) as structural units, together with an ester having a polymerizable double bond.

Monomer (w1): hydrocarbon having a polymerizable double bond:

Examples include an aliphatic hydrocarbon having a polymerizable double bond (w11) and an aromatic hydrocarbon having a polymerizable double bond (w12) described below.

(w11) Aliphatic hydrocarbon having a polymerizable double bond:

Examples include (w11) and (w112) described below.

(w11) Acyclic hydrocarbon having a polymerizable double bond: Examples include C2-C30 alkenes (e.g., isoprene, 1,4-pentadiene, 1,5-hexadiene, and 1,7-octadiene).

(w112) Cyclic hydrocarbon having a polymerizable double bond: Examples include C6-C30 mono- or dicycloalkenes (e.g., cyclohexene, vinylcyclohexene, and ethylidenebicycloheptene) and C5-C30 mono- or dicycloalkadienes (e.g., (di)cyclopentadiene).

(w12) Aromatic hydrocarbon having a polymerizable double bond: Examples include styrene; hydrocarbyl (at least one of C1-C30 alkyl, cycloalkyl, aralkyl, or alkenyl) substitute of styrene (e.g., α-methylstyrene, vinyltoluene, 2,4-dimethylstyrene, ethylstyrene, isopropylstyrene, butylstyrene, phenylstyrene, cyclohexylstyrene, benzylstyrene, crotylbenzene, divinylbenzene, divinyltoluene, divinylxylene, and trivinylbenzene); and vinylnaphthalene.

(w2) Monomer having a carboxyl group and a polymerizable double bond, and salt thereof:

Examples include C3-C15 unsaturated monocarboxylic acids (e.g., (meth)acrylic acid ("(meth)acryl" means acryl or methacryl), crotonic acid, isocrotonic acid, and cinnamic acid); C3-C30 unsaturated dicarboxylic acids (anhydride) (e.g., (anhydrous) maleic acid, fumaric acid, itaconic acid, (anhydrous) citraconic acid, and mesaconic acid); and monoalkyl (C1-C10) esters of C3-C10 unsaturated dicarboxylic acids (e.g., monomethyl maleate, monodecyl maleate, monoethyl fumarate, monobutyl itaconate, and monodecyl citraconate).

Examples of salts to form salts of the monomers having a carboxyl group and a polymerizable double bond include alkali metal salts (e.g., sodium salt and potassium salt), alkaline earth metal salts (e.g., calcium salt and magnesium salt), ammonium salts, amine salts, and quaternary ammonium salts.

Any amine salt may be used as long as it is an amine compound. Examples include primary amine salts (e.g., ethylamine salt, butylamine salt, and octylamine salt), secondary amines (e.g., diethylamine salt and dibutylamine salt), and tertiary amines (e.g., triethylamine salt and tributylamine salt). Examples of quaternary ammonium salts include tetraethyl ammonium salt, triethyl lauryl ammonium salt, tetrabutyl ammonium salt, and tributyl lauryl ammonium salt.

Examples of salts of the monomers having a carboxyl group and a polymerizable double bond include sodium acrylate, sodium methacrylate, monosodium maleate, disodium maleate, potassium acrylate, potassium methacrylate, monopotassium maleate, lithium acrylate, cesium acrylate, ammonium acrylate, calcium acrylate, and aluminum acrylate.

(w3) Monomer having a sulfo group and a polymerizable double bond, and salt thereof:

Examples include C2-C14 alkene sulfonic acids (e.g., vinyl sulfonic acid, (meth)allylsulfonic acid, and methylvinylsulfonic acid); styrenesulfonic acids and alkyl(C2-C24) derivatives thereof (e.g., α-methylstyrenesulfonic acid); C5-C18 sulfo(hydroxy)alkyl-(meth)acrylates (e.g., sulfopropyl (meth)acrylate, 2-hydroxy-3-(meth)acryloxypropyl sulfonic acid, 2-(meth)acryloyloxy ethane sulfonic acid, and 3-(meth)acryloyloxy-2-hydroxypropanesulfonic acid); C5-C18 sulfo(hydroxy)alkyl(meth)acrylamides (e.g., 2-(meth)acryloylamino-2,2-dimethylethanesulfonic acid, 2-(meth)acrylamide-2-methylpropanesulfonic acid, and 3-(meth)acrylamide-2-hydroxypropanesulfonic acid); alkyl (C3-C18) alkylsulfosuccinic acids (e.g., propylallylsulfosuccinic acid, butylallylsulfosuccinic acid, and 2-ethylhexylallylsulfosuccinic acid); poly [n (polymerization degree; hereinafter the same)=2 to 30] oxyalkylenes (e.g., oxyethylene, oxypropylene, and oxybutylene; oxyalkylenes may be contained alone or in combination, and when contained in combination, they may be added in random or block) mono(meth)acrylate sulfates (e.g., poly(n=5 to 15)oxyethylene monomethacrylate sulfate and poly(n=5 to 15)oxypropylene monomethacrylate sulfate); and salts thereof.

Examples of salts include those mentioned above as examples of salts to form salts of the monomers having a carboxyl group and a polymerizable double bond (w2).

(w4) Monomer having a phosphono group and a polymerizable double bond, and salt thereof:

Examples include (meth)acryloyloxyalkyl phosphoric acid monoesters (C1-C24 alkyl group) (e.g., 2-hydroxyethyl (meth)acryloylphosphate and phenyl-2-acryloyloxyethyl phosphate), and (meth)acryloyloxyalkyl phosphoric acids (C1-C24 alkyl group) (e.g., 2-acryloyloxyethyl phosphonic acid).

Examples of salts include those mentioned above as examples of salts to form salts of the monomers having a carboxyl group and a polymerizable double bond (w2).

(w5) Monomer having a hydroxyl group and a polymerizable double bond:

Examples include hydroxystyrene, N-methylol (meth) acrylamide, hydroxyethyl (meth)acrylate, hydroxypropyl (meth)acrylate, polyethylene glycol mono(meth)acrylate, (meth)allyl alcohol, crotyl alcohol, isocrotyl alcohol, 1-buten-3-ol, 2-buten-1-ol, 2-buten-1,4-diol, propargyl alcohol, 2-hydroxyethylpropenyl ether, and sucrose allyl ether.

(w6) Nitrogen-containing monomer having a polymerizable double bond:

Examples include a monomer having an amino group and a polymerizable double bond (w61), a monomer having an amide group and a polymerizable double bond (w62), a C3-C10 monomer having a nitrile group and a polymerizable double bond (w63), and a C8-C12 monomer having a nitro group and a polymerizable double bond (w64).

(w61) Monomer having an amino group and a polymerizable double bond:

Examples include aminoethyl (meth)acrylate, dimethylaminoethyl (meth)acrylate, diethylaminoethyl (meth)acrylate, t-butylaminoethyl (meth)acrylate, N-aminoethyl (meth) acrylamide, (meth)allylamine, morpholinoethyl (meth) acrylate, 4-vinylpyridine, 2-vinylpyridine, crotylamine, N,N-dimethylamino styrene, methyl-α-acetoamino acrylate, vinylimidazole, N-vinylpyrrole, N-vinylthiopyrolidone, N-arylphenylenediamine, aminocarbazole, aminothiazole, aminoindole, aminopyrrole, aminoimidazole, aminomercaptothiazole, and salts thereof.

(w62) Monomer having an amide group and a polymerizable double bond:

Examples include (meth)acrylamide, N-methyl(meth) acrylamide, N-butylacrylamide, diacetone acrylamide, N-methylol (meth)acrylamide, N,N'-methylene-bis(meth) acrylamide, cinnamic acid amide, N,N-dimethylacrylamide, N,N-dibenzylacrylamide, methacryl formamide, N-methyl-N-vinylacetamide, and N-vinylpyrrolidone.

(w63) C3-C10 monomer having a nitrile group and a polymerizable double bond:

Examples include (meth)acrylonitrile, cyanostyrene, and cyanoacrylate.

(w64) C8-C12 monomer having a nitro group and a polymerizable double bond:

Examples include nitrostyrene.

(w7) C6-C18 monomer having an epoxy group and a polymerizable double bond:

Examples include glycidyl (meth)acrylate and p-vinylphenylphenyl oxide.

(w8) C2-C16 monomer having halogen and a polymerizable double bond:

Examples include vinyl chloride, vinyl bromide, vinylidene chloride, allyl chloride, chlorostyrene, bromostyrene, dichlorostyrene, chloromethylstyrene, tetrafluorostyrene, and chloroprene.

(w9) Ether having a polymerizable double bond, ketone having a polymerizable double bond, and sulfur-containing compound having a polymerizable double bond:

Examples include a C3-C16 ether having a polymerizable double bond (w91), a C4-C12 ketone having a polymerizable double bond (w92), and a C2-C16 sulfur-containing compound having a polymerizable double bond (w93).

(w91) C3-C16 ether having a polymerizable double bond:

Examples include vinyl methyl ether, vinyl ethyl ether, vinyl propyl ether, vinyl butyl ether, vinyl-2-ethylhexyl ether, vinyl phenyl ether, vinyl-2-methoxyethyl ether, methoxy butadiene, vinyl-2-butoxyethyl ether, 3,4-dihydro-1,2-pyran, 2-butoxy-2'-vinyloxy diethyl ether, acetoxystyrene, and phenoxystyrene.

(w92) C4-C12 ketone having a polymerizable double bond:

Examples include vinyl methyl ketone, vinyl ethyl ketone, and vinyl phenyl ketone.

(w93) C2-C16 sulfur-containing compound having a polymerizable double bond:

Examples include divinyl sulfide, p-vinyl diphenyl sulfide, vinyl ethyl sulfide, vinyl ethyl sulfone, divinyl sulfone, and divinyl sulfoxide.

Preferred among the examples of the crystalline segment (a1) miscible with resin (B) in view of low-temperature fixability are the crystalline polyester (a11), the crystalline polyurethane (a12), and the crystalline polyurea (a13). The crystalline polyester (a11) and the crystalline polyurethane (a12) are more preferred. The segment (a1) having a structure formed of any of these compounds is preferred.

As describe above, the crystalline resin (A) may include the segment (a2) together with the crystalline segment (a1) miscible with the resin (B). The segment (a2) may have any chemical structure as long as it is immiscible with the resin (B). Examples of the compounds immiscible with the resin (B) include long-chain alkyl monoalcohols (preferably, C18-C42), long-chain alkyl monocarboxylic acids (preferably C18-C42), alcohol-modified butadiene, and alcohol-modified dimethylsiloxane. Preferred among these are C18-C42 long-chain alkyl monoalcohols and C18-C42 long-chain alkyl monocarboxylic acids. The segment (a2) having a structure formed of any of these compounds is preferred. Preferred examples of C18-C42 long-chain alkyl monoalcohols include behenyl alcohol and stearyl alcohol.

The crystalline resin (A) of the present invention preferably has a structure in which the segment (a1) and the segment (a2) are chemically bonded in the same molecule. The crystalline resin (A) preferably contains at least one selected from the group consisting of an ester group, a urethane group, a urea group, an amide group, an epoxy group, and a vinyl group.

The crystalline resin (A) may contain not only a combination of one segment (a1) and one segment (a2) but also combinations of three or more segments. The segment (a1) and the segment (a2) may be directly chemically bonded to each other, or the segment (a1) and the segment (a2) may be bonded to each other through a segment (a3) different from the segment (a1) and the segment (a2).

Examples of the segment (a3) include an amorphous segment miscible to the resin (B).

Thus, when three or more segments are contained, examples of combinations of these segments include a combination of one segment (a1), one segment (a2), and one segment (a3); a combination of two segments (a1) and one segment (a2); and a combination of one segment (a1) and two segments (a2). Herein, as an example of a combination of two or more segments, there is a case where these segments have the same chemical structures (for example, these segments are polyesters) but are different in molecular weight or other physical properties.

In view of low-temperature fixability, the chemical bond is preferably formed through at least one functional group selected from the group consisting of an ester group, a urethane group, a urea group, an amide group, and an epoxy group. An ester group and a urethane group are more preferred from the same view point.

In the present invention, the segment (a1) and the segment (a2) in the crystalline resin (A) are preferably bonded through at least one functional group selected from the group consisting of an ester group, a urethane group, a urea group, an amide group, and an epoxy group. The crystalline resin (A) having the segment (a1) and the segment (a2) which are bonded through at least one functional group selected from the group consisting of an ester group, a urethane group, a urea group, an amide group, and an epoxy group is preferred as the crystalline resin (A) of the present invention.

The weight average molecular weight (hereinafter, the weight average molecular weight may be abbreviated to "Mw") of the crystalline resin (A) is preferably 8,000 to 150,000, more preferably 10,000 to 110,000, particularly preferably 12,000 to 100,000, in view of low-temperature fixability and gloss.

The Mw and the number average molecular weight (herein also referred to as "Mn") is determined by gel permeation chromatography (GPC) under the following conditions using a sample solution obtained by dissolving the crystalline resin (A) in tetrahydrofuran (THF).

Device (an example): HLC-8120 available from Tosoh Corporation

Column (an example): TSK GEL GMH6 (available from Tosoh Corporation), two columns Measurement temperature: 40° C.

Sample solution: 0.25% by weight solution in THF

Amount of solution injected: 100 μL

Detector: Refractive index detector

Standard substance: Standard polystyrene available from Tosoh Corporation (TSK standard POLYSTYRENE), 12 samples (molecular weight: 500, 1050, 2800, 5970, 9100, 18100, 37900, 96400, 190000, 355000, 1090000, and 2890000)

The resin (B) used in the toner and the toner binder of the present invention may have any composition as long as it is a polyester resin or its modified resin, the polyester resin being obtained by reaction of the alcohol component (X) and the carboxylic acid component (Y) as raw materials. The alcohol component (X) is preferably a polyol component such as a diol.

A modified resin of the polyester resin is preferably one obtained by modifying the polyester resin by at least one selected from the group consisting of a urethane group, a urea group, an amide group, an epoxy group, and a vinyl group.

Examples of the resin (B) that is a polyester resin or its modified resin include an amorphous polyester resin (B1), an amorphous styrene (co)polymer-modified polyester resin (B2), an amorphous epoxy resin-modified polyester resin (B3), and an amorphous urethane resin-modified polyester resin (B4). Preferred among these as the resin (B) that is a polyester resin or its modified resin is the amorphous polyester resin (B1).

For example, the amorphous styrene (co)polymer-modified polyester resin (B2), the amorphous epoxy resin-modified polyester resin (B3), and the amorphous urethane resin-modified polyester resin (B4) are preferred as resins obtained by modifying a polyester resin by a vinyl group, an epoxy group, and a urethane group, respectively.

The term "amorphous resin" as used herein refers to a resin that exhibits a stepwise endothermic change, not a clear endothermic peak, in the first heating process as measured by a DSC as described above.

The amorphous polyester resin (B1) may be a polyester resin obtainable by reaction of a polyol component and the carboxylic acid component (Y) as raw materials.

Examples of the polyol component constituting the amorphous polyester resin (B1) may be the same as those of the diol component (x) used for the crystalline polyester (a11). A tri- or higher polyol may be optionally used in combination with the diol component (x). Examples of the tri- or higher polyol may be the same as those of the tri- or higher polyol used for the crystalline polyester (a11).

Preferred polyol components among those in view of low-temperature fixability and hot offset resistance are C2-C12 alkylene glycols, bisphenol polyoxyalkylene ether (number of AO units: 2 to 30) (bisphenol A AO adduct (addition molar number: 2 to 30)), tri- to octahydric or higher hydric aliphatic alcohols, and novolak resin polyoxyalkylene ether (number of AO units: 2 to 30) (novolak resin AO adduct (addition molar number: 2 to 30)).

C2-C10 alkylene glycols, bisphenol polyoxyalkylene ether (number of AO units: 2 to 5), and novolak resin polyoxyalkylene ether (number of AO units: 2 to 30) are more preferred. C2-C6 alkylene glycols, bisphenol A polyoxyalkylene ether (number of AO units: 2 to 5) are particularly preferred. Ethylene glycol, propylene glycol, bisphenol A polyoxyalkylene ether (number of AO units: 2 to 3) are most preferred.

To obtain an amorphous resin, the linear diol content is preferably 70% by mole or less, more preferably 60% by mole or less, of the diol component (x) used. In addition, the diol component (x) preferably accounts for 90 to 100% by mole of the polyol component constituting the amorphous polyester resin (B1).

Examples of the carboxylic acid component (Y) constituting the amorphous polyester resin (B1) may be the same as those of the dicarboxylic acid component (y) used for the crystalline polyester (a11).

Tri- or higher valent carboxylic acids and monocarboxylic acids may also be used.

Examples of tri- or higher valent carboxylic acids include C9-C20 aromatic polycarboxylic acids (e.g., trimellitic acid and pyromellitic acid), C6-C36 aliphatic tricarboxylic acids (e.g., hexanetricarboxylic acid), vinyl polymers of unsaturated carboxylic acids [Mn: 450 to 10,000] (e.g., styrene/maleic acid copolymer, styrene/acrylic acid copolymer, and styrene/fumaric acid copolymer).

Examples of monocarboxylic acids include C1-C30 aliphatic (including alicyclic) monocarboxylic acids and C7-C36 aromatic monocarboxylic acids (e.g., benzoic acid).

Preferred among these carboxylic acid components in view of the balance between low-temperature fixability and hot offset resistance are benzoic acid, C2-C50 alkane dicarboxylic acids, C4-C50 alkene dicarboxylic acids, C8-C20 aromatic dicarboxylic acids, and C9-C20 aromatic polycarboxylic acids (e.g., trimellitic acid and pyromellitic acid).

Benzoic acid, adipic acid, C16-C50 alkenyl succinic acids, terephthalic acid, isophthalic acid, maleic acid, fumaric acid, trimellitic acid, pyromellitic acid, and combinations of two or more thereof are more preferred. Adipic acid, terephthalic acid, trimellitic acid, and combinations of two or more thereof are particularly preferred.

Anhydrides or lower alkyl esters of these carboxylic acids are similarly preferred.

The glass transition temperature (Tg) of the resin (B) is preferably 40° C. to 75° C., more preferably 45° C. to 72° C., particularly preferably 50° C. to 70° C., in view of low-temperature fixability, gloss, toner flowability, heat-resistant storage stability, image strength after fixing, folding resistance, and document offset resistance.

The Tg is measured by a DSC according to a method specified in ASTM D3418-82 (DSC method).

The Mw of the amorphous polyester resin (B1) is preferably 2,000 to 200,000, more preferably 2,500 to 100,000, particularly preferably 3,000 to 60,000, in view of low-temperature fixability, gloss, toner flowability, heat-resistant storage stability, grindability, image strength after fixing, folding resistance, and document offset resistance.

The Mw and the Mn of the resin (B) are determined by GPC in the same manner as for the crystalline resin (A).

The acid value of the resin (B) is preferably 30 mg KOH/g or less, more preferably 20 mg KOH/g or less, still more preferably 15 mg KOH/g or less, in view of low-temperature fixability, gloss, toner flowability, heat-resistant storage stability, electrostatic stability, grindability, image strength after fixing, folding resistance, and document offset resistance. The acid value is particularly preferably 10 mg KOH/g or less, most preferably 5 mg KOH/g or less.

In the present invention, the acid value can be measured by a method specified in JIS K 0070.

The method for reducing the acid value of the resin (B) is not particularly limited. For example, any of the following methods can be used: increasing the molecular weight; decreasing the feed amount of trimellitic anhydride for half-esterification; end-capping with a monoalcohol or the like, crosslinking with a tri- or higher functional acid, alcohol, or the like; and adjusting the ratio of acid to alcohol when feeding raw materials such as urethane or the like in such a manner that the amount of the alcohol is slightly excessive so that a terminal functional group is an alcohol.

The hydroxyl value of the resin (B) is preferably 30 mg KOH/g or less, more preferably 20 mg KOH/g or less, still more preferably 15 mg KOH/g or less, in view of low-temperature fixability, gloss, toner flowability, heat-resistant storage stability, electrostatic stability, grindability, image strength after fixing, folding resistance, and document offset resistance. The hydroxyl value is particularly preferably 10 mg KOH/g or less, most preferably 5 mg KOH/g or less.

In the present invention, the hydroxyl value can be measured by a method specified in JIS K 0070.

The method for reducing the hydroxyl value of the resin (B) is not particularly limited. For example, any of the following methods can be used: increasing the molecular weight; end-capping with a monocarboxylic acid or the like; crosslinking with a tri- or higher functional acid, alcohol, or the like; and adjusting the ratio of acid to alcohol when feeding raw materials such as urethane or the like in such a manner that the amount of the acid is slightly excessive so that a terminal functional group is an acid.

When the molecular weight of the resin (B) as measured by gel permeation chromatography is expressed as the peak area, the amount of molecules having a molecular weight of 1,000 or less in the resin (B) is preferably 10% or less, more preferably 8% or less, still more preferably 6% or less, particularly preferably 4% or less, most preferably 2% or less, of the total peak area, in view of toner flowability, heat-resistant storage stability, electrostatic stability, grindability, image strength after fixing, folding resistance, and document offset resistance. If the amount of molecules having a molecular weight of 1,000 or less in the resin (B) is in the above range, the toner flowability, heat-resistant storage stability, electrostatic stability, grindability, image strength after fixing, folding resistance, and document offset resistance will be excellent.

In the present invention, the amount of molecules having a molecular weight of 1,000 or less in the resin (B) is determined from the molecular weight results obtained by GPC as described above by processing the results into data as follows.

(1) The retention time at which the molecular weight is 1,000 is determined from a calibration curve plotted on a molecular weight axis and a retention time axis.

(2) The total peak area (Σ1) is determined.

(3) The area of peaks after the retention time determined in (1) (i.e., the peak area with a molecular weight of 1,000 or less) (Σ2) is determined.

(4) The amount of molecules having a molecular weight of 1,000 or less is determined from the following equation. Amount of molecules having a molecular weight of 1,000 or less (%)=(Σ2)×100/(Σ1)

The method for reducing the amount of molecules having a molecular weight of 1,000 or less in the resin (B) is not particularly limited. For example, any of the following methods can be used: increasing the molecular weight of the resin (B); end-capping with a monocarboxylic acid or the like; and crosslinking with a tri- or higher functional acid or the like.

The amorphous polyester resin (B1) may be the polyester resin (B11) obtained by reaction of the alcohol component (X) containing an aromatic diol (x1) in an amount of 80% by mole or more and the carboxylic acid component (Y) as raw materials, and the following the equation (5) is preferably satisfied when the solubility parameter (SP value) of the crystalline resin (A) is regarded as $SP_A$, the solubility parameter of the resin (B) is regarded as $SP_B$, the acid value of the resin (B) is regarded as $AV_B$ and the hydroxyl value of the resin (B) is regarded as $OHV_B$ in view of the balance among heat-resistant storage stability, low-temperature fixability, and gloss.

$$|SP_A - SP_B| \geq 0.0050 \times (AV_B + OHV_B) + 1.258 \quad (5)$$

In the equation (5), $SP_A$ is the SP value of the crystalline resin (A), $SP_B$ is the SP value of the resin (B), $AV_B$ is the acid value of the resin (B), and $OHV_B$ is the hydroxyl value of the resin (B).

In one preferred embodiment of the present invention, the toner binder as described above is provided in which the resin (B) is the polyester resin (B11) obtained by reaction of the alcohol component (X) containing the aromatic diol (x1) in an amount of 80% by mole or more and the carboxylic acid component (Y) as raw materials and in which the equation (5) is satisfied.

In the present invention, the SP can be measured by the Fedors' method [Polym. Eng. Sci. 14(2) 152, (1974)].

Examples of the aromatic diol (x1) include bisphenol (e.g., bisphenol A, bisphenol F, or bisphenol S) AO (e.g., EO, PO, or BO) adducts (addition molar number: 2 to 30). Two or more of these may be used in combination.

The alcohol component (X) containing the aromatic diol (x1) in an amount of 80% by mole or more is preferred in view of low-temperature fixability, heat-resistant storage stability, image strength, folding resistance, and document offset resistance.

The amorphous polyester resin (B1) may be the polyester resin (B12) obtained by reaction of the alcohol component (X) containing a C2-C10 aliphatic alcohol (x2) in an amount of 80% by mole or more and the carboxylic acid component (Y) as raw materials, and the following equation (6) is preferably satisfied in view of the balance among heat-resistant storage stability, low-temperature fixability, and gloss.

$$|SP_A - SP_B| \geq 1.9 \quad (6)$$

In the equation (6), $SP_A$ is the SP value of the crystalline resin (A), and $SP_B$ is the SP value of the resin (B).

In one preferred embodiment of the present invention, the toner binder as described above is provided in which the resin (B) is the polyester resin (B12) obtained by reaction of the alcohol component (X) containing the C2-C10 aliphatic alcohol (x2) in an amount of 80% by mole or more and the carboxylic acid component (Y) as raw materials and in which the equation (6) is satisfied. The value of ($|SP_A - SP_B|$) on the left-hand side of the equation (6) is preferably 5 or less, more preferably 3 or less, still more preferably 2.5 or less.

Examples of the C2-C10 aliphatic alcohol (x2) include aliphatic diols such as ethylene glycol, 1,2-propanediol (1,2-propylene glycol), 1,3-propanediol, 1,4-butanediol, neopentyl glycol, 2,3-dimethylbutane-1,4-diol, 1,5-pentanediol, 1,6-hexanediol, 1,7-heptanediol, 1,8-octanediol, 1,9-nonanediol, and 1,10-decanediol. Two or more of these may be used in combination.

The carbon number of 2 to 10 is preferred in view of low-temperature fixability, hot offset resistance, and heat-resistant storage stability.

The alcohol component (X) containing the C2-C10 aliphatic alcohol (x2) in an amount of 80% by mole or more is preferred in view of low-temperature fixability, hot offset resistance, electrostatic stability, and grindability.

The amorphous polyester resin (B1) may be the polyester resin (B13) obtained by reaction of the alcohol component (X) and the carboxylic acid component (Y) as raw materials, the alcohol component (X) contains the aromatic diol (x1) and the C2-C10 aliphatic alcohol (x2) at a molar ratio of 20/80 to 80/20, and the following equation (7) is preferably satisfied in view of the balance among heat-resistant storage stability, low-temperature fixability, and gloss.

$$|SP_A - SP_B| \geq 0.0117 \times (AV_B + OHV_B) + 1.287 \quad (7)$$

In the equation (7), $SP_A$ is the SP value of the crystalline resin (A), $SP_B$ is the SP value of the resin (B), $AV_B$ is the acid value of the resin (B), and $OHV_B$ is the hydroxyl value of the resin (B).

In one preferred embodiment of the present invention, the toner binder as described above is provided in which the resin (B) is the polyester resin (B13) obtained by reaction of the alcohol component (X) containing the aromatic diol (x1) and the C2-C10 aliphatic alcohol (x2) at a molar ratio of 20/80 to 80/20 and the carboxylic acid component (Y) as raw materials and in which the above equation (7) is satisfied.

The softening point (Tm) of the resin (B) as measured by a flow tester is preferably 80° C. to 170° C., more preferably 85° C. to 165° C., particularly preferably 90° C. to 160° C.

The softening point (Tm) is measured by the following method.

Using an elevated flow tester (e.g., CFT-500D available from Shimadzu Corporation), 1 g of a measurement sample is heated at a heating rate of 6° C./rain. While the sample is heated, a load of 1.96 MPa is applied to the sample by a plunger to extrude the sample by a nozzle having a diameter of 1 mm and a length of 1 mm. Then, a graph showing relationship between "plunger descending amount (flow amount)" and "temperature" is drawn to read a temperature corresponding to ½ of the maximum plunger descending amount. This temperature (i.e., temperature at which a half of the sample has flown out) is regarded as the softening point (Tm).

The toner binder of the present invention may contain two or more of the resins (B) having different softening points (Tm's). A preferred combination is one having a Tm of 80° C. to 110° C. and one having a Tm of 110° C. to 170° C.

The toner binder of the present invention may contain the amorphous styrene (co)polymer-modified polyester resin (B2) as the resin (B).

The amorphous styrene (co)polymer-modified polyester resin (B2) is a product obtainable by reaction of a homopolymer of styrene-based monomers and a polyester, or a product obtainable by reaction of a copolymer of a styrene-based monomer and a (meth)acrylic monomer and a polyester.

Examples of styrene-based monomers include styrene and alkylstyrenes (e.g., α-methylstyrene and p-methylstyrene) in which an alkyl group has 1 to 3 carbon atoms. Styrene is preferred.

Examples of (meth)acrylic monomers that can be used in combination include alkyl esters (C1-C18 alkyl group) such as methyl (meth)acrylate, ethyl (meth)acrylate, butyl (meth) acrylate, 2-ethylhexyl (meth)acrylate, lauryl (meth)acrylate, and stearyl (meth)acrylate; hydroxyl group-containing (meth)acrylates (C1-C18 alkyl group) such as hydroxylethyl (meth)acrylate; amino group-containing (meth)acrylates (C1-C18 alkyl group) such as dimethylaminoethyl (meth) acrylate, and diethylaminoethyl (meth)acrylate; acrylonitrile, methacrylonitrile, nitrile group-containing (meth) acrylic compounds in which a methyl group in methacrylonitrile is replaced by a C2-C18 alkyl group; and (meth)acrylic acid.

Preferred among these are methyl (meth)acrylate, ethyl (meth)acrylate, butyl(meth)acrylate, 2-ethylhexyl(meth) acrylate, (meth)acrylic acid, and mixtures of two or more thereof.

The amorphous styrene (co)polymer-modified polyester resin (B2) may contain another vinyl ester monomer or aliphatic hydrocarbon-based vinyl monomer.

Examples of vinyl ester monomers include aliphatic vinyl esters (C4-C15, e.g., vinyl acetate, vinyl propionate, and isopropenyl acetate), unsaturated carboxylic acid polyhydric (dihydric or trihydric) alcohol esters (C8-C200, e.g., ethylene glycol di(meth)acrylate, propylene glycol di(meth)acrylate, neopentyl glycol di(meth)acrylate, trimethylolpropane tri(meth)acrylate, 1,6-hexanediol diacrylate, and polyethylene glycol di(meth)acrylate), and aromatic vinyl esters (C9-C15, e.g., methyl-4-vinyl benzoate).

Examples of aliphatic hydrocarbon-based vinyl monomers include olefins (C2-C10, e.g., ethylene, propylene, butene, and octene) and diens (C4-C10, e.g., butadiene, isoprene, and 1,6-hexadiene).

In the present invention of the toner, The Mw of the amorphous styrene (co)polymer-modified polyester resin (B2) is usually 100,000 to 300,000, preferably 130,000 to 280,000, more preferably 150,000 to 250,000, in view of fixing temperature range.

The ratio Mw/Mn of the Mw to the number average molecular weight (Mn) of the amorphous styrene (co)polymer-modified polyester resin (B2) is usually 10 to 70, preferably, 15 to 65, more preferably 20 to 60, in view of fixing temperature range.

The toner binder of the present invention may contain two or more amorphous styrene (co)polymer-modified polyester resins (B2) having different molecular weights in view of fixing temperature range.

The toner binder of the present invention may also contain the amorphous epoxy resin-modified polyester resin (B3) as the resin (B).

Examples of the amorphous epoxy resin-modified polyester resin (B3) include products obtained by reaction of a ring-opening polymer of polyepoxide and a polyester, and products obtained by reaction of a polyadduct of polyepoxide and an active hydrogen-containing compound (e.g., water, polyol such as diol or tri- or higher polyol, dicarboxylic acid, tri- or higher valent polycarboxylic acid, or polyamine) and a polyester.

The toner binder of the present invention may also contain the amorphous urethane resin-modified polyester resin (B4) as the resin (B).

Examples of the amorphous urethane resin-modified polyester resin (B4) include products obtained by reaction of the diisocyanate (v2), a monoisocyanate (v1), a tri- or higher functional polyisocyanate (v3), and a polyester.

Examples of the monoisocyanate (v1) include phenyl isocyanate, tolyl isocyanate, xylyl isocyanate, α,α,α',α'-tetramethylxylyl isocyanate, naphthyl isocyanate, ethyl isocyanate, propyl isocyanate, hexyl isocyanate, octyl isocyanate, decyl isocyanate, dodecyl isocyanate, tetradecyl isocyanate, hexadecyl isocyanate, octadecyl isocyanate, cyclobutyl isocyanate, cyclohexyl isocyanate, cyclooctyl isocyanate, cyclodecyl isocyanate, cyclododecyl isocyanate, cyclotetradecyl isocyanate, isophorone isocyanate, dicyclohexylmethane-4-isocyanate, cyclohexylene isocyanate, methyl cyclohexylene isocyanate, norbornane isocyanate, and bis(2-isocyanatoethyl)-4-cyclohexene-1,2-dicarboxylate.

The tri- or higher functional polyisocyanate (v3) is not particularly limited as long as it is a compound having three or more isocyanate groups. Examples include compounds containing a chemical structure of triisocyanate, tetraisocyanate, isocyanurate, or biuret.

In the present invention, when the glass transition temperature of the resin (B) is regarded as $Tg_1$ (° C.), and the glass transition temperature derived from the resin (B) in a mixture obtained by adding the crystalline resin (A) to the resin (B) is regarded as $Tg_2$ (° C.), preferably, the glass transition temperature $Tg_1$ (° C.) of the resin (B) and the glass transition temperature $Tg_2$ (° C.) derived from the resin (B) in a mixture obtained by adding the crystalline resin (A) to the resin (B) satisfy the equation (2) shown below.

The mixture obtained by adding the crystalline resin (A) to the resin (B) is preferably the toner binder of the present invention.

$$Tg_1 - Tg_2 \leq 15 \quad (2)$$

The method of mixing the crystalline resin (A) with the resin (B) is not particularly limited. Examples include a method in which the crystalline resin (A) is mixed with the resin (B) by a melt-kneader, a method in which these components are dissolved in a solvent or the like to be mixed and the solvent is removed afterwards, and a method in which the resin (B) is mixed with the crystalline resin (A) during production of the resin (B). The mixing temperature is preferably 100° C. to 200° C., more preferably 110° C. to 190° C., in view of resin viscosity.

The toner binder of the present invention can be obtained, for example, by mixing the crystalline resin (A) and the resin (B) as described above.

The value of the left-hand side of the equation (2) is usually 15 or less, preferably 12 or less, more preferably 10 or less, still more preferably 5 or less, particularly preferably 3 or less, in view of toner flowability, heat-resistant storage stability, grindability, and image strength after fixing. It is better if the value of the left-hand side of the equation (2) is smaller.

If the value of the left-hand side is smaller, it means that the crystalline resin (A) is likely to recrystallize and a decrease in the Tg does not easily occur.

The weight ratio (B)/(A) of the resin (B) to the crystalline resin (A) is usually 50/50 to 95/5, preferably 60/40 to 92/8, more preferably 70/30 to 90/10, in view of toner flowability, heat-resistant storage stability, grindability, image strength after fixing, low-temperature fixability, and gloss. A mixture containing the resin (B) and the crystalline resin (A) at the above ratio is preferred as the toner binder of the present invention. Specifically, the weight ratio (B)/(A) of the resin (B) to the crystalline resin (A) in the toner binder of the present invention is preferably in the above range.

In the present invention, when the glass transition temperature $Tg_1$ of the resin (B) plus 30 degrees (° C.) is higher than the temperature Tp (° C.) of the top of the endothermic peak derived from the crystalline resin (A), the toner binder is preferably wholly or partially turbid at the temperature of $Tg_1$ plus 30 degrees, and when the temperature of $Tg_1$ plus 30 degrees is lower than the temperature Tp, the toner binder may be wholly or partially turbid at the temperature Tp. In the present invention, it is preferred that the toner binder is wholly turbid at the above temperature, and it is more preferred that the toner binder is partially turbid at the above temperature.

When a mixture of the crystalline resin (A) and the resin (B) obtained by any of the above mixing methods is visually observed, the mixture is preferably wholly or partially turbid at the temperature of $Tg_1$ plus 30 degrees (° C.) when the temperature of $Tg_1$ plus 30 degrees (° C.) is higher than the temperature Tp (° C.) of the top of the endothermic peak derived from the crystalline resin (A); and the mixture is preferably wholly or partially turbid at the temperature Tp when the temperature of $Tg_1$ plus 30 degrees (° C.) is lower than the temperature Tp. The turbidity indicates that the crystalline resin (A) is not completely miscible with the resin (B), and it is preferred because the crystalline resin (A) is easily recrystallized when cooled.

When there are two or more endothermic peaks derived from the crystalline resin (A), the temperature of the highest top of the endothermic peak among these is regarded as the temperature Tp in this case.

As mentioned above, the crystalline resin (A) is preferably a resin having at least two chemically bonded segments including the crystalline segment (a1) miscible with the resin (B) and the segment (a2) immiscible with the resin (B).

At this point, when the solubility parameter of the resin (B) that is a polyester resin or its modified resin is $SP_B$, the solubility parameter of the segment (a1) is regarded as $SP_{a1}$, and the solubility parameter of the segment (a2) is regarded as $SP_{a2}$, the segment (a1) and the segment (a2) preferably satisfy both the following equations (3) and (4).

$$|SP_{a1} - SP_B| \leq 1.9 \quad (3)$$

$$|SP_{a2} - SP_B| \geq 1.9 \quad (4)$$

In the equation, $SP_{a1}$ is the SP value of the segment (a1), $SP_{a2}$ is the SP value of the segment (a2), and $SP_B$ is the SP value of the resin (B).

The SP values of the segment (a1) and the segment (a2) are the SP values of the compounds constituting the segments.

The value of the left-hand side of the equation (3) is usually 1.9 or less, preferably 0.1 to 1.8, in view of miscibility between the resin (B) and the segment (a1).

Likewise, the value of the left-hand side of the equation (4) is usually 1.9 or more, preferably 2.0 or more, in view of miscibility between the resin (B) and the segment (a2). The upper limit of the value of the left-hand side of the equation (4) is preferably 4.0 or lower, more preferably 3.5 or lower.

As the equations (3) and (4) are both satisfied, the crystalline resin (A) is easily plasticized when heated and is easily recrystallized when cooled, thus improving low-temperature fixability, gloss, toner flowability, heat-resistant storage stability, image strength after fixing, and folding resistance.

The toner binder of the present invention is formed from the crystalline resin (A) and the resin (B), and may optionally contain other components as long as the effects of the present invention are not impaired. The toner binder may consist of the crystalline resin (A) and the resin (B).

A toner containing the toner binder of the present invention and the colorant is also encompassed by the present invention.

The toner of the present invention is preferably a composition containing a toner binder containing the resin (B) and the crystalline resin (A), and a colorant.

The colorant is not limited. The toner of the present invention may contain any dye or any pigment which is used as a colorant for a toner can be used.

Specific examples include carbon black, iron black, Sudan Black SM, Fast Yellow G, Benzidine Yellow, Pigment Yellow, Indofast Orange, Irgazin Red, para-nitroaniline red, Toluidine Red, Carmine FB, Pigment Orange R, Lake Red 2G, Rhodamine FB, Rhodamine B Lake, Methyl Violet B Lake, Phthalocyanine Blue, Pigment Blue, Brilliant Green, Phthalocyanine Green, Oil Yellow GG, Kayaset YG, Orazole Brown B, and Oil Pink OP. These may be used alone or in combination of two or more thereof.

Optionally, magnetic powder (e.g., powder of ferromagnetic metals such as iron, cobalt, and nickel, and compounds such as magnetite, hematite, and ferrite) can be added to also serve as a coloring agent.

The amount of the colorant is preferably 1 to 40 parts by weight, more preferably 3 to 10 parts by weight, when the total of the resin (B) and the crystalline resin (A) is 100 parts by weight.

The amount of the magnetic powder, when used, is preferably 20 to 150 parts by weight, more preferably 40 to 120 parts by weight, relative to the total of 100 parts by weight of the resin (B) and the crystalline resin (A). The "part(s)" means part(s) by weight" throughout the description.

The toner of the present invention may optionally contain at least one additive selected from the group consisting of a mold release agent, a charge control agent, and a fluidizing agent together with the crystalline resin (A), the resin (B), and the colorant.

A mold release agent having a softening point (Tm) of 50° C. to 170° C. as measured by a flow tester is preferred. Examples include polyolefin wax, natural wax, C30-C50 aliphatic alcohols, C30-C50 fatty acids, and mixtures thereof.

Examples of polyolefin waxes include (co)polymers of olefins (e.g., ethylene, propylene, 1-butene, isobutylene, 1-hexene, 1-dodecene, 1-octadecen, and mixtures thereof) (such (co)polymers include those obtained by (co)polymerization and thermally degraded polyolefins); oxides of (co) polymers of olefins by at least one of oxygen or ozone; (co)polymers of olefins modified by maleic acid (e.g., (co) polymers modified with maleic acid or a derivative thereof (e.g., maleic anhydride, maleic monomethyl maleate, monobutyl maleate, and dimethyl maleate)); (co)polymers of olefins and at least one of unsaturated carboxylic acids (e.g., (meth)acrylic acid, itaconic acid, and maleic anhydride) or unsaturated carboxylic acid alkyl esters (e.g., (meth)acrylic acid alkyl (C1-C18 alkyl) esters) and maleic acid alkyl (C1-C18 alkyl) esters); and Sasol Wax.

Examples of natural waxes include carnauba wax, montan wax, paraffin wax, and rice wax. Examples of C30-C50 aliphatic alcohols include triacontanol. Examples of C30-C50 fatty acids include triacontan carboxylic acid.

Examples of the charge control agent include nigrosine dyes, triphenylmethane-based dyes containing a tertiary amine as a side chain, quaternary ammonium salts, polyamine resins, imidazole derivatives, quaternary ammonium salt-containing polymers, metal-containing azo dyes, copper phthalocyanine dyes, metal salts of salicylic acid, boron complexes of benzilic acid, sulfonic acid group-containing polymers, fluorine-containing polymers, and halogen-substituted aromatic ring-containing polymers.

Examples of the fluidizing agent include colloidal silica, alumina powder, titanium oxide powder, and calcium carbonate powder.

The method for producing the toner of the present invention is not particularly limited.

The toner of the present invention may be one obtained by any known method such as a kneading-grinding method, a phase inversion emulsification method, or a polymerization method.

For example, the toner can be produced by a kneading-grinding method as follows: components of the toner excluding a fluidizing agent are dry-blended, melt-kneaded, coarsely ground, and ultimately ground into fine particles using a jet mill or the like; and these particles are further classified to obtain fine particles having a volume average particle size (D50) of preferably 5 to 20 μm, followed by mixing with a fluidizing agent.

The volume average particle size (D50) is measured using a Coulter counter (e.g., Multisizer III (product name) available from Beckman Coulter, Inc.).

In addition, the toner can be produced by a phase inversion emulsification method as follows: components of the toner excluding a fluidizing agent are dissolved or dispersed in an organic solvent; and the solution or dispersion is formed into an emulsion by adding water or the like, followed by separation and classification. The volume average particle size of the toner is preferably 3 to 15 μm.

The toner of the present invention is optionally mixed with carrier particles, such as iron powder, glass beads, nickel powder, ferrite, magnetite, and ferrite whose surfaces are coated with a resin (e.g., acrylic resin, and silicone resin), and used as a developer for electric latent images. The weight ratio of the toner to the carrier particles is usually 1/99 to 100/0 (toner/carrier particles). It is also possible to form electric latent images by friction with a member such as a charging blade instead of the carrier particles.

The toner of the present invention is fixed to a support (e.g., paper and polyester film) using a copier, a printer, or the like to form a recording material. The toner can be fixed to a support by a known method such as a heat roll fixing method or a flash fixing method.

EXAMPLES

The present invention is further described below with reference to examples and comparative examples, but the present invention is not limited to these examples. Hereafter, "part(s)" indicates "part(s) by weight and "%" indicates" % by weight.

The SP values ($SP_{a1}$ and $SP_{a2}$) of the crystalline segment (a1) and the segment (a2) were determined by the Fedors' method [Polym. Eng. Sci. 14(2) 152, (1974)].

Production Example 1

<Synthesis of Crystalline Segment (a1-1)>

Sebacic acid (696 parts), 1,6-hexanediol (424 parts), and tetrabutoxy titanate (0.5 parts) as a condensation catalyst were placed in a reaction vessel equipped with a condenser, a stirrer, and a nitrogen inlet tube, and were allowed to react at 170° C. under a nitrogen stream for 8 hours while generated water was removed by distillation. Subsequently, while the temperature was gradually increased to 220° C., the reaction was carried out under a nitrogen stream for 4 hours while generated water was removed by distillation. The reaction was further carried out under a reduced pressure of 0.5 to 2.5 kPa, and a reaction product was taken out when the acid value was 0.5 or less. The resin taken out was cooled to room temperature, and then ground into particles. Thus, a crystalline polyester (a1-1) was obtained. $SP_{a1}$ of the crystalline polyester (a1-1) was 9.9.

Production Example 2

<Synthesis of Crystalline Segment (a1-2)>

A crystalline polyester (a1-2) was obtained by the same reaction as in Production Example 1, except that sebacic acid (774 parts) and 1,4-butanediol (360 parts) were used as raw materials. $SP_{a1}$ of the crystalline polyester (a1-2) was 10.1.

Production Example 3

<Synthesis of Crystalline Segment (a1-3)>

A crystalline polyester (a1-3) was obtained by the same reaction as in Production Example 1, except that dodecanedioic acid (798 parts) and 1,4-butanediol (326 parts) were used as raw materials. $SP_{a1}$ of the crystalline polyester (a1-3) was 9.9.

Production Example 4

<Synthesis of Crystalline Segment (a1-4)>

A crystalline polyester (a1-4) was obtained by the same reaction as in Production Example 1, except that dodecanedioic acid (723 parts) and 1,6-hexanediol (390 parts) were used as raw materials. $SP_{a1}$ of the crystalline polyester (a1-4) was 9.8.

Production Example 5

<Synthesis of Crystalline Segment (a1-5)>

A crystalline polyester (a1-5) was obtained by the same reaction as in Production Example 1, except that sebacic acid (604 parts) and 1,9-nonanediol (503 parts) were used as raw materials. $SP_{a1}$ of the crystalline polyester (a1-5) was 9.7.

Production Example 6

<Synthesis of Crystalline Segment (a1-6)>

A crystalline polyester (a1-6) was obtained by the same reaction as in Production Example 1, except that dodecanedioic acid (634 parts) and 1,9-nonanediol (465 parts) were used as raw materials. $SP_{a1}$ of the crystalline polyester (a1-6) was 9.6.

Production Example 7

<Synthesis of Crystalline Segment (a1-7)>

A crystalline polyester (a1-7) was obtained by the same reaction as in Production Example 1, except that adipic acid (456 parts) and 1,12-dodecanediol (656 parts) were used as raw materials. $SP_{a1}$ of the crystalline polyester (a1-7) was 9.7.

Production Example 8

<Synthesis of Crystalline Segment (a1-8)>

A crystalline polyester (a1-8) was obtained by the same reaction as in Production Example 1, except that sebacic acid (531 parts) and 1,12-dodecanediol (563 parts) were used as raw materials. $SP_{a1}$ of the crystalline polyester (a1-8) was 9.6.

Production Example 9

<Synthesis of Crystalline Segment (a1-9)>

Sebacic acid (878 parts), ethylene glycol (478 parts), and tetrabutoxy titanate (0.5 parts) as a condensation catalyst were placed in a reaction vessel equipped with a condenser, a stirrer, and a nitrogen inlet tube, and were allowed to react at 170° C. under a nitrogen stream for 8 hours while generated water was removed by distillation. Subsequently, while the temperature was gradually increased to 220° C., the reaction was carried out under a nitrogen stream for 4 hours while generated water was removed by distillation. The reaction was further carried out under a reduced pressure of 0.5 to 2.5 kPa, and a reaction product was taken out when the Mw was 20000 or more. The amount of the recovered ethylene glycol was 200 parts. The resin taken out was cooled to room temperature, and then ground into particles. Thus, a crystalline polyester (a1-9) was obtained. $SP_{a1}$ of the crystalline polyester (a1-9) was 10.3.

The crystalline polyesters (a1-1) to (a1-9) obtained in Production Examples 1 to 9 were regarded as the crystalline segments (a1-1) to (a1-9), respectively.

Production Example 10

<Synthesis of Segment (a2-1)>

A crystalline polyester (a2-1) was obtained by the same reaction as in Production Example 1, except that dodecanedioic acid (561 parts) and 1,12-dodecanediol (524 parts) were used as raw materials. $SP_{a2}$ of the crystalline polyester (a2-1) was 9.5. The crystalline polyester (a2-1) was regarded as the segment (a2-1).

Production Example 11

<Segment (a2-2)>

Behenyl alcohol was provided as a segment (a2-2). $SP_{a2}$ was 9.3.

Production Example 12

<Segment (a2-3)>

Stearyl alcohol was provided as a segment (a2-3). $SP_{a2}$ was 9.5.

Production Example 13

<Segment (a2-4)>

Polybd 45HT (trademark) (hydroxyl-terminated liquid polybutadiene available from Idemitsu Kosan Co., Ltd.) was provided as a segment (a2-4). $SP_{a2}$ was 8.9.

Production Example 14

<Segment (a2-5)>

Silaplane FM-0411 (hydroxyl-terminated dimethylsilicone available from Chisso Corporation) was provided as a segment (a2-5). $SP_{a2}$ was 7.8.

Production Example 15

<Synthesis of Amorphous Segment (a3-1)>

An amorphous polyester (a3-1) was obtained by the same reaction as in Production Example 1, except that a bisphenol A propylene oxide (2 mol) adduct (738 parts) and terephthalic acid (332 parts) were used as raw materials. $SP_{a3}$ of the amorphous polyester (a3-1) was 11.1. The amorphous polyester (a3-1) was regarded as the amorphous segment (a3-1).

In Production Examples 16 to 32 described below, the crystalline resin (A) was produced. In Production Examples 33 to 38, the resin (B) was produced. In Comparative Production Examples 1 to 7, a crystalline segment (a'1), a segment (a'2), and a crystalline resin (A') were produced for comparison. In Comparative Production Example 8, a styrene acrylic resin (resin (B')) was produced as a resin for comparison.

The temperature (Tp) of the top of the endothermic peak of the crystalline resin (A) was measured by a differential scanning calorimeter (DSC) according to the following method.

Device: Q Series Version 2.8.0.394 (available from TA Instruments)

A heating/cooling/heating pattern for measurement temperature was as follows.

(1) Heating from 20° C. to 180° C. at a heating rate of 10° C./min (2) After leaving to stand at 180° C. for 10 minutes, cooling to 0° C. at a cooling rate of 10° C./min (3) After leaving to stand at 0° C. for 10 minutes, heating again to 180° C. at a heating rate of 10° C./min About 5 mg of the resin was accurately weighed, placed in an aluminium pan, and measured once. An empty aluminium pan was used as a reference. At this point, the temperature at the lower point of the negative endothermic peak of the crystalline resin (A) in the heating process (3) (i.e., the second heating process) was regarded as the temperature Tp of the top of the endothermic peak. When there were two or more endothermic peaks derived from crystalline resin (A), the temperature of the top of the highest endothermic peak among these was regarded as the temperature Tp.

The weight average molecular weight (Mw) of the resin was determined by gel permeation chromatography (GPC) under the following conditions using a sample solution obtained by dissolving the resin in tetrahydrofuran (THF).

Device: HLC-8120 available from Tosoh Corporation

Column: TSK GEL GMH6 (available from Tosoh Corporation), two columns

Measurement temperature: 40° C.

Sample solution: 0.25% by weight solution in THF

Amount of solution injected: 100 μL

Detector: Refractive index detector

Standard substance: Standard polystyrene available from Tosoh Corporation (TSK standard POLYSTYRENE), 12 samples (molecular weight: 500, 1050, 2800, 5970, 9100, 18100, 37900, 96400, 190000, 355000, 1090000, and 2890000)

The Tg ($Tg_1$) of the resin (B) was measured by a DSC (Q Series Version 2.8.0.394 available from TA Instruments) according to a method (DSC method) specified in ASTM D3418-82.

The SP value ($SP_A$) of the crystalline resin (A) and the SP value ($SP_B$) of the resin (B) were determined by the Fedors' method [Polym. Eng. Sci. 14(2) 152, (1974)].

The acid value and the hydroxyl value of the resin (B) were measured by a method according to JIS K 0070.

The amount of molecules having a molecular weight of 1,000 or less in the resin (B) was determined from the measurement results of the resins obtained by GPC as described above by processing the results into data as follows.

(1) The retention time at which the molecular weight is 1,000 was determined from a calibration curve plotted on a molecular weight axis and a retention time axis.

(2) The total peak area (Σ1) was determined.

(3) The area of peaks (peak area with a molecular weight of 1,000 or less) (Σ2) after the retention time determined in (1) was determined.

(4) The amount of molecules having a molecular weight of 1,000 or less was determined from the following equation.

Amount of molecules having a molecular weight of 1,000 or less (%)=(Σ2)×100/(Σ1)

The amount of molecules having a molecular weight of 1,000 or less (%) as determined above was regarded as "the amount of molecules having a molecular weight of 1,000 or less".

Production Example 16

<Synthesis of Crystalline Resin (A-1)>

The crystalline segment (a1-1) (415 parts) and the segment (a2-1) (415 parts) were placed in a reaction vessel equipped with a stirrer and a nitrogen inlet tube, and uniformly dissolved at 100° C. Further, hexamethylene diisocyanate (170 parts) was placed therein, and the reaction was carried out at 100° C. for 3 hours. Thus, a crystalline resin (A-1) was obtained. The temperature Tp of the crystalline resin (A-1) was 70° C. and the Mw thereof was 70,000.

Production Example 17

<Synthesis of Crystalline Resin (A-2)>

Aebacic acid (12 parts), the crystalline segment (a1-1) (920 parts), the segment (a2-2) (80 parts), and tetrabutoxy titanate (0.5 parts) as a condensation catalyst were placed in a reaction vessel equipped with a condenser, a stirrer, and a nitrogen inlet tube, and were allowed to react at 220° C. under a reduced pressured of 0.5 to 2.5 kPa for 10 hours. Thus, a crystalline resin (A-2) was obtained. The temperature Tp of the crystalline resin (A-2) was 67° C. and the Mw thereof was 15,000.

Production Example 18

<Synthesis of Crystalline Resin (A-3)>

A crystalline resin (A-3) was obtained by the same reaction as in Production Example 16, except that the crystalline segment (a1-2) (300 parts), the segment (a2-1) (300 parts), the amorphous segment (a3-1) (250 parts), and hexamethylene diisocyanate (150 parts) were used as raw materials. The temperature Tp of the crystalline resin (A-3) was 68° C. and the Mw thereof was 80,000.

Production Example 19

<Synthesis of Crystalline Resin (A-4)>

A crystalline resin (A-4) was obtained by the same reaction as in Production Example 17, except that sebacic acid (23 parts), the crystalline segment (a1-1) (920 parts), and the segment (a2-3) (80 parts) were used as raw materials. The temperature Tp of the crystalline resin (A-4) was 67° C. and the Mw thereof was 19,000.

Production Example 20

<Synthesis of Crystalline Resin (A-5)>

The crystalline segment (a1-1) (369 parts), the segment (a2-4) (35 parts), and methyl ethyl ketone (400 parts) were placed in an autoclave reaction vessel equipped with a stirrer, and were uniformly dissolved at 75° C. Further, hexamethylene diisocyanate (10 parts) was placed therein, and the reaction was carried out at 90° C. for 12 hours. Subsequently, methyl ethyl ketone was removed by distillation under a reduced pressure. Thus, a crystalline resin (A-5) was obtained. The temperature Tp of the crystalline resin (A-5) was 66° C. and the Mw thereof was 66,000.

Production Example 21

<Synthesis of Crystalline Resin (A-6)>

A crystalline resin (A-6) was obtained by the same reaction as in Production Example 20, except that the crystalline segment (a1-1) (230 parts), the segment (a2-5) (56 parts), methyl ethyl ketone (300 parts), and hexamethylene diisocyanate (14 parts) were used as raw materials. The temperature Tp of the crystalline resin (A-6) was 66° C. and the Mw thereof was 45,000.

Production Example 22

<Synthesis of Crystalline Resin (A-7)>

A crystalline resin (A-7) was obtained by the same reaction as in Production Example 20, except that the crystalline segment (a1-1) (347 parts), the segment (a2-2) (32 parts), methyl ethyl ketone (400 parts), and hexamethylene diisocyanate (21 parts) were used as raw materials. The temperature Tp of the crystalline resin (A-7) was 67° C. and the Mw thereof was 41,000.

Production Example 23

<Synthesis of Crystalline Resin (A-8)>

A crystalline resin (A-8) was obtained by the same reaction as in Production Example 17, except that dodecanedioic acid (14 parts), the crystalline segment (a1-3) (950 parts), and the segment (a2-2) (38 parts) were used as raw materials. The temperature Tp of the crystalline resin (A-8) was 65° C. and the Mw thereof was 23,000.

Production Example 24

<Synthesis of Crystalline Resin (A-9)>

A crystalline resin (A-9) was obtained by the same reaction as in Production Example 17, except that dodecanedioic acid (13 parts), the crystalline segment (a1-4) (950 parts), and the segment (a2-2) (19 parts) were used as raw materials. The temperature Tp of the crystalline resin (A-9) was 72° C. and the Mw thereof was 28,000.

Production Example 25

<Synthesis of Crystalline Resin (A-10)>

A crystalline resin (A-10) was obtained by the same reaction as in Production Example 17, except that sebacic acid (26 parts), the crystalline segment (a1-5) (950 parts), and the segment (a2-2) (50 parts) were used as raw materials. The temperature Tp of the crystalline resin (A-10) was 70° C. and the Mw thereof was 36,000.

Production Example 26

<Synthesis of Crystalline Resin (A-11)>

A crystalline resin (A-11) was obtained by the same reaction as in Production Example 17, except that dodecanedioic acid (11 parts), the crystalline segment (a1-6) (950 parts), and the segment (a2-2) (19 parts) were used as raw materials. The temperature Tp of the crystalline resin (A-11) was 73° C. and the Mw thereof was 30,000.

Production Example 27

<Synthesis of Crystalline Resin (A-12)>

A crystalline resin (A-12) was obtained by the same reaction as in Production Example 17, except that adipic acid (4 parts), the crystalline segment (a1-7) (950 parts), and the segment (a2-2) (61 parts) were used as raw materials. The temperature Tp of the crystalline resin (A-12) was 77° C. and the Mw thereof was 17,000.

Production Example 28

<Synthesis of Crystalline Resin (A-13)>

A crystalline resin (A-13) was obtained by the same reaction as in Production Example 17, except that sebacic acid (14 parts), the crystalline segment (a1-8) (950 parts), and the segment (a2-2) (30 parts) were used as raw materials. The temperature Tp of the crystalline resin (A-13) was 85° C. and the Mw thereof was 29,000.

Production Example 29

<Synthesis of Crystalline Resin (A-14)>

A crystalline resin (A-14) was obtained by the same reaction as in Production Example 17, except that sebacic acid (14 parts), the crystalline segment (a1-9) (950 parts), and the segment (a2-2) (20 parts) were used as raw materials. The temperature Tp of the crystalline resin (A-14) was 75° C. and the Mw thereof was 30,000.

Production Example 30

<Synthesis of Crystalline Resin (A-15)>

Sebacic acid (21 parts), the crystalline segment (a1-1) (950 parts), the segment (a2-2) (19 parts), and tetrabutoxy titanate (0.5 parts) as a condensation catalyst were placed in a reaction vessel equipped with a condenser, a stirrer, and a nitrogen inlet tube, and were allowed to react at 220° C. under a reduced pressure of 0.5 to 2.5 kPa for 10 hours. After cooling to 80° C., hexamethylene diisocyanate (2 parts) was placed in the reaction vessel, and the reaction was carried out at 100° C. for 5 hours. Thus, a crystalline resin (A-15) was obtained. The temperature Tp of the crystalline resin (A-15) was 68° C. and the Mw thereof was 40,000.

Production Example 31

<Synthesis of Crystalline Resin (A-16)>

Dodecanedioic acid (25 parts), the crystalline segment (a1-4) (950 parts), the segment (a2-2) (19 parts), and tetrabutoxy titanate (0.5 parts) as a condensation catalyst were placed in a reaction vessel equipped with a condenser, a stirrer, and a nitrogen inlet tube, and were allowed to react at 220° C. under a reduced pressure of 0.5 to 2.5 kPa for 10 hours. After cooling to 80° C., hexamethylene diisocyanate (2 parts) was placed in the reaction vessel, and the reaction was carried out at 100° C. for 5 hours. Thus, a crystalline resin (A-16) was obtained. The temperature Tp of the crystalline resin (A-16) was 73° C. and the Mw thereof was 38,000.

Production Example 32

<Synthesis of Crystalline Resin (A-17)>

The crystalline segment (a1-1) (415 parts) and the crystalline segment (a1-4) (415 parts) were placed in a reaction vessel equipped with a stirrer and a nitrogen inlet tube, and were uniformly dissolved at 100° C. Further, hexamethylene diisocyanate (170 parts) was placed in the reaction vessel, and the reaction was carried out at 100° C. for 3 hours. Thus, a crystalline resin (A-17) was obtained. The temperature Tp of the crystalline resin (A-17) was 68° C. and the Mw thereof was 79,000.

Production Example 33

<Synthesis of Resin (B-1)>

1,2-Propylene glycol (522 parts), a bisphenol A ethylene oxide (2 mol) adduct (1 part), a bisphenol A propylene oxide (2 mol) adduct (1 part), terephthalic acid (468 parts), adipic acid (90 parts), benzoic acid (20 parts), trimellitic anhydride (26 parts), and tetrabutoxy titanate (3 parts) as a condensation catalyst were placed in a reaction vessel, and were allowed to react at 220° C. under an increased pressure for 20 hours while generated water was removed by distillation.

Subsequently, the pressure was gradually reduced to normal pressure, and further reduced to 0.5 to 2.5 kPa, under which the reaction was carried out.

When the Tm was 130° C., a resin (b-1) was taken out using a steel belt cooler.

1,2-Propylene glycol (458 parts), a bisphenol A ethylene oxide (2 mol) adduct (1 part), a bisphenol A propylene oxide (2 mol) adduct (40 parts), terephthalic acid (493 parts), adipic acid (6 parts), benzoic acid (70 parts), trimellitic anhydride (46 parts), and tetrabutoxy titanate (3 parts) as a condensation catalyst were placed in another reaction vessel, and were allowed to react at 220° C. under increased pressure for 10 hours while generated water was removed by distillation.

Subsequently, the pressure was gradually reduced to normal pressure, and further reduced to 0.5 to 2.5 kPa, under which the reaction was carried out. When the Tm was 105° C., the pressure was returned to normal pressure, and the temperature was lowered to 180° C. Trimellitic anhydride (14 parts, 0.07 mol) was added to the reaction vessel, and the reaction was carried out for 1 hour. The temperature was lowered to 150° C., and a resin (b-2) was taken out using a steel belt cooler.

The resin (b-1) and the resin (b-2) obtained above were uniformly mixed by a Henschel mixer (FM10B available from Nippon Coke & Engineering Co., Ltd.) to obtain a weight ratio (b-1)/(b-2) of 50/50. Thus, a resin (B-1) was obtained. The resin (B-1) had the following properties: Tg of 63° C., Mw of 30,000, acid value of 20, hydroxyl value of 19, amount of molecules having a molecular weight of 1,000 or less of 9.5%, and $SP_B$ of 11.7.

Production Example 34

<Synthesis of Resin (B-2)>

A bisphenol A ethylene oxide (2 mol) adduct (322 parts), a bisphenol A propylene oxide (2 mol) adduct (419 parts), terephthalic acid (274 parts), and tetrabutoxy titanate (3 parts) as a condensation catalyst were placed in a reaction vessel, and were allowed to react at 220° C. under increased pressure for 10 hours while generated water was removed by distillation. Subsequently, the pressure was gradually reduced to normal pressure, and further reduced to 0.5 to 2.5 kPa, under which the reaction was carried out. When the Tm was 100° C., the pressure was returned to normal pressure, and the temperature was lowered to 180° C. Trimellitic anhydride (42 parts) was added to the reaction vessel, and the reaction was carried out for 1 hour. The temperature was lowered to 150° C., and a resin (b-3) was taken out using a steel belt cooler.

A bisphenol A ethylene oxide (2 mol) adduct (167 parts), a bisphenol A propylene oxide (2 mol) adduct (128 parts), a bisphenol A propylene oxide (3 mol) adduct (468 parts), terephthalic acid (184 parts), trimellitic anhydride (53 parts), and tetrabutoxy titanate (3 parts) as a condensation catalyst were placed in another reaction vessel, and were allowed to react at 220° C. under increased pressure for 10 hours while generated water was removed by distillation. Subsequently, the pressure was gradually reduced to normal pressure, and further reduced to 0.5 to 2.5 kPa, under which the reaction was carried out. When the Tm was 110° C., the pressure was returned to normal pressure, and the temperature was lowered to 180° C. Trimellitic anhydride (52 parts) was added to the reaction vessel. The temperature was raised to 210° C., and the pressure was reduced to 0.5 to 2.5 kPa, under which the reaction was carried out. When the Tm was 145° C., a resin (b-4) was taken out using a steel belt cooler.

The resin (b-3) and the resin (b-4) obtained above were uniformly mixed by a Henschel mixer (FM10B available from Nippon Coke & Engineering Co., Ltd.) to obtain a weight ratio (b-3)/(b-4) of 50/50. Thus, a resin (B-2) was obtained. The resin (B-2) had the following properties: Tg of 62° C., Mw of 140,000, acid value of 22, hydroxyl value of 38, amount of molecules having a molecular weight of 1,000 or less of 12.2%, and $SP_B$ of 11.3.

Production Example 35

<Synthesis of Resin (B-3)>

A bisphenol A ethylene oxide (2 mol) adduct (688 parts), terephthalic acid (295 parts), benzoic acid (72 parts), and tetrabutoxy titanate (3 parts) as a condensation catalyst were placed in a reaction vessel, and were allowed to react at 220° C. under increased pressure for 10 hours while generated water was removed by distillation. Subsequently, the pressure was gradually reduced to normal pressure, and further reduced to 0.5 to 2.5 kPa, under which the reaction was carried out. When the Tm was 95° C., the pressure was returned to normal pressure, and the temperature was lowered to 180° C. Trimellitic anhydride (17 parts) was added to the reaction vessel, and the reaction was carried out for 1 hour. The temperature was lowered to 150° C., and a resin (b-5) was taken out using a steel belt cooler.

A bisphenol A ethylene oxide (2 mol) adduct (1 part), a bisphenol A propylene oxide (2 mol) adduct (122 parts), a bisphenol A propylene oxide (3 mol) adduct (620 parts), terephthalic acid (242 parts), maleic anhydride (1 part), trimellitic anhydride (6 parts), and tetrabutoxy titanate (3 parts) as a condensation catalyst were placed in another reaction vessel, and were allowed to react at 220° C. under increased pressure for 10 hours while generated water was removed by distillation. Subsequently, the pressure was gradually reduced to normal pressure, and further reduced to 0.5 to 2.5 kPa, under which the reaction was carried out. When the Tm was 100° C., the pressure was returned to normal pressure, and the temperature was lowered to 180° C. Trimellitic anhydride (73 parts) was added to the reaction vessel. The temperature was raised to 210° C., and the pressure was reduced to 0.5 to 2.5 kPa, under which the reaction was carried out. When the Tm was 145° C., a resin (b-6) was taken out using a steel belt cooler.

The resin (b-5) and the resin (b-6) obtained above were uniformly mixed by a Henschel mixer (FM10B available from Nippon Coke & Engineering Co., Ltd.) to obtain a weight ratio (b-5)/(b-6) of 50/50. Thus, a resin (B-3) was obtained. The resin (B-3) had the following properties: Tg of 62° C., Mw of 150,000, acid value of 16, hydroxyl value of 2, amount of molecules having a molecular weight of 1,000 or less of 6.9%, and $SP_B$ of 11.1.

Production Example 36

<Synthesis of Resin (B-4)>

1,2-Propylene glycol (581 parts), a bisphenol A ethylene oxide (2 mol) adduct (1 part), a bisphenol A propylene oxide (2 mol) adduct (49 parts), terephthalic acid (625 parts), adipic acid (8 parts), benzoic acid (49 parts), trimellitic anhydride (58 parts), and tetrabutoxy titanate (3 parts) as a condensation catalyst were placed in a reaction vessel, and were allowed to react at 220° C. under increased pressure for 20 hours while generated water was removed by distillation.

Subsequently, the pressure was gradually reduced to normal pressure, and further reduced to 0.5 to 2.5 kPa, under which the reaction was carried out. When the Tm was 107° C., the pressure was returned to normal pressure, and the temperature was lowered to 180° C. Then, trimellitic anhydride (17 parts) was added to the reaction vessel, and the reaction was carried out for 1 hour. The temperature was lowered to 150° C., and a resin (b-7) was taken out using a steel belt cooler.

1,2-Propylene glycol (649 parts), a bisphenol A ethylene oxide (2 mol) adduct (1 part), a bisphenol A propylene oxide (2 mol) adduct (1 part), terephthalic acid (673 parts), adipic acid (32 parts), benzoic acid (34 parts), trimellitic anhydride (52 parts), and tetrabutoxy titanate (3 parts) as a condensation catalyst were placed in another reaction vessel, and were allowed to react at 220° C. under increased pressure for 10 hours while generated water was removed by distillation.

Subsequently, the pressure was gradually reduced to normal pressure, and further reduced to 0.5 to 2.5 kPa, under which the reaction was carried out. When the Tm was 130° C., a resin (b-8) was taken out using a steel belt cooler.

The resin (b-7) and the resin (b-8) obtained above were uniformly mixed by a Henschel mixer (FM10B available from Nippon Coke & Engineering Co., Ltd.) to obtain a weight ratio (b-7)/(b-8) of 50/50. Thus, a resin (B-4) was obtained. The resin (B-4) had the following properties: Tg of 63° C., Mw of 69,000, acid value of 6, hydroxyl value of 24, amount of molecules having a molecular weight of 1,000 or less of 9.0%, and $SP_B$ of 11.9.

Production Example 37

<Synthesis of Resin (B-5)>

The resin (b-3) and the resin (b-8) obtained above were uniformly mixed by a Henschel mixer (FM10B available from Nippon Coke & Engineering Co., Ltd.) to obtain a weight ratio (b-3)/(b-8) of 50/50. Thus, a resin (B-5) was obtained. The resin (B-5) had the following properties: Tg of 64° C., Mw of 31,000, acid value of 12, hydroxyl value of 33, amount of molecules having a molecular weight of 1,000 or less of 10.9%, and $SP_B$ of 11.7.

Production Example 38

<Synthesis of Resin (B-6)>

A bisphenol A ethylene oxide (2 mol) adduct (556 parts), a bisphenol A propylene oxide (2 mol) adduct (197 parts), terephthalic acid (267 parts), maleic anhydride (1 part), and tetrabutoxy titanate (3 parts) as a condensation catalyst were placed in a reaction vessel, and were allowed to react at 220° C. under increased pressure for 10 hours while generated water was removed by distillation.

Subsequently, the pressure was gradually reduced to normal pressure, and further reduced to 0.5 to 2.5 kPa, under which the reaction was carried out. When the acid value was 1.5, the pressure was returned to normal pressure, and the temperature was lowered to 180° C. Trimellitic anhydride (43 parts) was added to the reaction vessel. The temperature was raised to 210° C., and the pressure was reduced to 0.5 to 2.5 kPa, under which the reaction was carried out. When the Tm was 140° C., a resin (b-9) was taken out using a steel belt cooler.

The resin (b-3) and the resin (b-9) obtained above were uniformly mixed by a Henschel mixer (FM10B available from Nippon Coke & Engineering Co., Ltd.) to obtain a weight ratio (b-3)/(b-9) of 50/50. Thus, a resin (B-6) was obtained. The resin (B-6) had the following properties: Tg of 64° C., Mw of 76,000, acid value of 11, hydroxyl value of 39, amount of molecules having a molecular weight of 1,000 or less of 8.1%, and $SP_B$ of 11.5.

Comparative Production Example 1

<Synthesis of Crystalline Segment (a'1-1) for Comparison>

A crystalline polyester (a'1-1) was obtained by the same reaction as in Production Example 1, except that fumaric acid (575 parts) and 1,6-hexanediol (600 parts) were used as raw materials. $SP_{a1}$ of the crystalline polyester (a'1-1) was 10.6. The crystalline polyester (a'1-1) was regarded as the crystalline segment (a'1-1).

Comparative Production Example 2

<Synthesis of Crystalline Segment (a'1-2) for Comparison>

A crystalline polyester (a'1-2) was obtained by the same reaction as in Production Example 1, except that azelaic acid (875 parts), fumaric acid (41 parts), and 1,4-butanediol (451 parts) were used as raw materials. $SP_{a1}$ of the crystalline polyester (a'1-2) was 10.2. The crystalline polyester (a'1-2) was regarded as the crystalline segment (a'1-2).

Comparative Production Example 3

<Segment (a'2-1) for Comparison>

1-Decanol was provided as a segment (a'2-1). $SP_{a2}$ was 10.0.

Comparative Production Example 4

<Crystalline Resin (A'-1) for Comparison>

A crystalline polyester (A'-1) was obtained by the same reaction as in Production Example 17, except that sebacic acid (17 parts), the crystalline segment (a1-1) (940 parts), and the segment (a'2-1) (60 parts) were used as raw materials. The temperature Tp of the crystalline polyester (A'-1) was 67° C. and the Mw thereof was 13,000. The crystalline polyester (A'-1) was regarded as the crystalline resin (A'-1).

Comparative Production Example 5

<Crystalline Resin (A'-2) for Comparison>

The crystalline segment (a1-1) was solely regarded as a crystalline resin (A'-2). The temperature Tp of the crystalline resin (A'-2) was 66° C. and the Mw thereof was 20,000.

Comparative Production Example 6

<Crystalline Resin (A'-3) for Comparison>

A crystalline polyester (A'-3) was obtained by the same reaction as in Production Example 17, except that the crystalline segment (a'1-1) (940 parts) and the segment (a2-2) (60 parts) were used as raw materials. The temperature Tp of the crystalline polyester (A'-3) was 115° C. and the Mw thereof was 14,000. The crystalline polyester (A'-3) was regarded as the crystalline resin (A'-3).

Comparative Production Example 7

<Crystalline Resin (A'-4) for Comparison>

The crystalline segment (a'1-2) was solely regard as a crystalline resin (A'-4). The temperature Tp of the crystalline resin (A'-2) was 60° C. and the Mw was 4,500.

Comparative Production Example 8

<Synthesis of Resin (B') for Comparison>

Xylene (80 parts by weight) was placed in an autoclave. After purging with nitrogen, the temperature was raised to 185° C. Subsequently, a mixed solution of styrene (54 parts by weight), n-butyl acrylate (28 parts by weight), methacrylic acid (4 parts by weight), n-octylmercaptan (2 parts by weight), di-t-butyl peroxide (0.23 parts by weight), and xylene (35 parts by weight) were added dropwise to the autoclave at the same temperature over 3 hours. Further, the resulting mixture was kept at the same temperature for 1 hour. Thus, a xylene solution of the resin (B') was obtained. Subsequently, the obtained xylene solution was heated to 170° C. while xylene was removed at 1 kPa or less. The resin was found by gas chromatography to contain 1,000 ppm of xylene and 1,000 ppm or less of residual monomers. Thus, the resin (B') was obtained. The resin (B') had the following properties: Tg of 60° C., Mw of 12,000, acid value of 7, hydroxyl value of 0, amount of molecules having a molecular weight of 1,000 or less of 9.0%, and $SP_B$ of 10.3. The resin (B') was a styrene acrylic resin.

Examples 1 to 18 and Comparative Examples 1 to 5

The crystalline resin (A) and the resin (B) obtained in Production Examples and Comparative Production Examples were formed into a toner according to the composition ratio (parts by weight) shown in Tables 1 and 2 by the following method. The "Tp (° C.) of resin (A)" in Tables 1 and 2 indicates the temperature (Tp) of the top of the endothermic peak of the crystalline resin (A) used in the toner.

A colorant (C-1) was carbon black (MA-100 available from Mitsubishi Chemical Corporation); a mold release agent (D-1) was polyolefin wax (Biscol 550P available from Sanyo Chemical Industries, Ltd.); a charge control agent (E-1) was aizen spilon black (T-77 available from Hodogaya Chemical Co., Ltd.); and a fluidizing agent (F-1) was colloidal silica (Aerosil R972 available from Nippon Aerosil. Co., Ltd.).

TABLE 1

| | | | Example | | | | | |
|---|---|---|---|---|---|---|---|---|
| | | | 1 (T-1) | 2 (T-2) | 3 (T-3) | 4 (T-4) | 5 (T-5) | 6 (T-6) |
| Amount (parts by weight) | Crystalline resin (A) | (A-1) | 8 | — | — | — | — | — |
| | | (A-2) | — | 8 | — | — | — | — |
| | | (A-3) | — | — | 8 | — | — | — |
| | | (A-4) | — | — | — | 10 | — | — |
| | | (A-5) | — | — | — | — | 10 | — |
| | | (A-6) | — | — | — | — | — | 10 |
| | | (A-7) | — | — | — | — | — | — |
| | | (A-8) | — | — | — | — | — | — |
| | | (A-9) | — | — | — | — | — | — |
| | | (A-10) | — | — | — | — | — | — |
| | | (A-11) | — | — | — | — | — | — |
| | | (A-12) | — | — | — | — | — | — |

TABLE 1-continued

| | | | | | | | | |
|---|---|---|---|---|---|---|---|---|
| | Resin | (B-1) | 92 | 92 | 92 | 90 | 90 | 90 |
| | (B) | (B-2) | — | — | — | — | — | — |
| | | (B-3) | — | — | — | — | — | — |
| | Colorant | (C-1) | 8 | 8 | 8 | 8 | 8 | 8 |
| | Mold release agent | (D-1) | 4 | 4 | 4 | 4 | 4 | 4 |
| | Charge control agent | (E-1) | 1 | 1 | 1 | 1 | 1 | 1 |
| | Fluidizing agent | (F-1) | 0.4 | 0.4 | 0.4 | 0.4 | 0.4 | 0.4 |
| Tp (° C.) of Resin (A) | | | 70 | 67 | 68 | 67 | 66 | 66 |
| $(S_2/S_1) \times 100$ | | | 90 | 80 | 72 | 74 | 65 | 60 |
| (A)-derived endothermic capacity (J/g) | | | 7.5 | 8.5 | 3.2 | 9.8 | 8.6 | 8.0 |
| $Tg_1$ (° C.) | | | 63 | 63 | 63 | 63 | 63 | 63 |
| $Tg_2$ (° C.) | | | 61 | 60 | 59 | 58 | 56 | 55 |
| $Tg_1 - Tg_2$ (° C.) | | | 2 | 3 | 4 | 5 | 7 | 8 |
| Miscibility (Presence or absence of turbidity) | $(Tg_1 + 30)$ ° C. | | Excellent | Excellent | Good | Excellent | Excellent | Excellent |
| | Tp ° C. | | — | — | — | — | — | — |
| $\lvert SP_{a1} - SP_B \rvert$ | | | 1.8 | 1.8 | 1.6 | 1.8 | 1.8 | 1.8 |
| $\lvert SP_{a2} - SP_B \rvert$ | | | 2.2 | 2.4 | 2.2 | 2.2 | 2.8 | 3.9 |
| $\lvert SP_A - SP_B \rvert$ | | | 2.0 | 1.9 | 1.4 | 1.9 | 1.9 | 2.2 |
| Value of right-hand side of equation (5) | | | — | — | — | — | — | — |
| Value of right-hand side of equation (6) | | | 1.9 | 1.9 | 1.9 | 1.9 | 1.9 | 1.9 |
| Value of right-hand side of equation (7) | | | — | — | — | — | — | — |
| Volume average particle size (μm) | | | 8 | 8 | 8 | 8 | 8 | 8 |
| Particle size distribution | | | 1.2 | 1.2 | 1.2 | 1.2 | 1.2 | 1.2 |

| | | | Example | | | | | |
|---|---|---|---|---|---|---|---|---|
| | | | 7 (T-7) | 8 (T-8) | 9 (T-9) | 10 (T-10) | 11 (T-11) | 12 (T-12) |
| Amount (parts by weight) | Crystalline resin | (A-1) | — | — | — | — | — | — |
| | (A) | (A-2) | — | — | — | — | — | — |
| | | (A-3) | — | — | — | — | — | — |
| | | (A-4) | — | — | — | — | — | — |
| | | (A-5) | — | — | — | — | — | — |
| | | (A-6) | — | — | — | — | — | — |
| | | (A-7) | 10 | — | — | — | — | — |
| | | (A-8) | — | 10 | — | — | — | — |
| | | (A-9) | — | — | 10 | — | — | — |
| | | (A-10) | — | — | — | 10 | — | — |
| | | (A-11) | — | — | — | — | 10 | — |
| | | (A-12) | — | — | — | — | — | 10 |
| | Resin | (B-1) | 90 | 90 | 90 | — | — | — |
| | (B) | (B-2) | — | — | — | 90 | — | 90 |
| | | (B-3) | — | — | — | — | 90 | — |
| | Colorant | (C-1) | 8 | 8 | 8 | 8 | 8 | 8 |
| | Mold release agent | (D-1) | 4 | 4 | 4 | 4 | 4 | 4 |
| | Charge control agent | (E-1) | 1 | 1 | 1 | 1 | 1 | 1 |
| | Fluidizing agent | (F-1) | 0.4 | 0.4 | 0.4 | 0.4 | 0.4 | 0.4 |
| Tp (° C.) of Resin (A) | | | 67 | 65 | 72 | 70 | 73 | 77 |
| $(S_2/S_1) \times 100$ | | | 73 | 80 | 88 | 76 | 88 | 81 |
| (A)-derived endothermic capacity (J/g) | | | 9.7 | 9.2 | 9.3 | 8.8 | 9.3 | 8.3 |
| $Tg_1$ (° C.) | | | 63 | 63 | 63 | 62 | 62 | 62 |
| $Tg_2$ (° C.) | | | 58 | 59 | 60 | 57 | 57 | 55 |
| $Tg_1 - Tg_2$ (° C.) | | | 5 | 4 | 3 | 5 | 5 | 7 |
| Miscibility (Presence or absence of turbidity) | $(Tg_1 + 30)$ ° C. | | Excellent | Excellent | Excellent | Good | Good | Good |
| | Tp ° C. | | — | — | — | — | — | — |
| $\lvert SP_{a1} - SP_B \rvert$ | | | 1.8 | 1.8 | 1.9 | 1.6 | 1.5 | 1.6 |
| $\lvert SP_{a2} - SP_B \rvert$ | | | 2.4 | 2.4 | 2.4 | 2.0 | 1.9 | 2.0 |
| $\lvert SP_A - SP_B \rvert$ | | | 1.9 | 1.9 | 2.0 | 1.6 | 1.6 | 1.6 |
| Value of right-hand side of equation (5) | | | — | — | — | 1.5 | 1.3 | 1.5 |
| Value of right-hand side of equation (6) | | | 1.9 | 1.9 | 1.9 | — | — | — |
| Value of right-hand side of equation (7) | | | — | — | — | — | — | — |
| Volume average particle size (μm) | | | 8 | 8 | 8 | 8 | 8 | 8 |
| Particle size distribution | | | 1.2 | 1.2 | 1.2 | 1.2 | 1.2 | 1.2 |

TABLE 2

| | | | Example | | | | | | Comparative Example | | | | |
|---|---|---|---|---|---|---|---|---|---|---|---|---|---|
| | | | 13 (T-13) | 14 (T-14) | 15 (T-15) | 16 (T-16) | 17 (T-17) | 18 (T-18) | 1 (T-1) | 2 (T-2) | 3 (T-3) | 4 (T-4) | 5 (T-5) |
| Amount (parts by weight) | Crystalline resin (A) | (A-13) | 10 | — | — | — | — | — | — | — | — | — | — |
| | | (A-14) | — | 10 | — | — | — | — | — | — | — | — | 10 |
| | | (A-15) | — | — | — | 10 | — | — | — | — | — | — | — |
| | | (A-16) | — | — | — | — | 10 | 10 | — | — | — | — | — |
| | | (A17) | — | — | 8 | — | — | — | — | — | — | — | — |
| | | (A'-1) | — | — | — | — | — | — | 8 | — | — | — | — |
| | | (A'-2) | — | — | — | — | — | — | — | 8 | — | — | — |
| | | (A'-3) | — | — | — | — | — | — | — | — | 8 | — | — |
| | | (A'-4) | — | — | — | — | — | — | — | — | — | 10 | — |
| | Resin (B) | (B-1) | — | — | 92 | — | — | — | 92 | 92 | 92 | — | — |
| | | (B-2) | — | — | — | — | — | — | — | — | — | 90 | — |
| | | (B-3) | 90 | — | — | — | — | — | — | — | — | — | — |
| | | (B-4) | — | 90 | — | 90 | — | — | — | — | — | — | — |
| | | (B-5) | — | — | — | — | 90 | — | — | — | — | — | — |
| | | (B-6) | — | — | — | — | — | 90 | — | — | — | — | — |
| | | (B') | — | — | — | — | — | — | — | — | — | — | 90 |
| | Colorant | (C-1) | 8 | 8 | 8 | 8 | 8 | 8 | 8 | 8 | 8 | 8 | 8 |
| | Mold release agent | (D-1) | 4 | 4 | 4 | 4 | 4 | 4 | 4 | 4 | 4 | 4 | 4 |
| | Charge control agent | (E-1) | 1 | 1 | 1 | 1 | 1 | 1 | 1 | 1 | 1 | 1 | 1 |
| | Fluidizing agent | (F-1) | 0.4 | 0.4 | 0.4 | 0.4 | 0.4 | 0.4 | 0.4 | 0.4 | 0.4 | 0.4 | 0.4 |
| Tp (° C.) of Resin (A) | | | 85 | 75 | 68 | 68 | 73 | 73 | 67 | 66 | 115 | 60 | 60 |
| $(S_2/S_1) \times 100$ | | | 92 | 40 | 55 | 96 | 94 | 89 | 0 | 5 | 72 | 10 | 95 |
| (A)-derived endothermic capacity (J/g) | | | 9.9 | 3.8 | 6.1 | 9.0 | 8.9 | 8.4 | 0 | 0 | 6.2 | 0.9 | 9.3 |
| $Tg_1$ (° C.) | | | 62 | 62 | 63 | 63 | 64 | 64 | 63 | 63 | 63 | 63 | 60 |
| $Tg_2$ (° C.) | | | 59 | 54 | 55 | 62 | 62 | 61 | 35 | 30 | 57 | 42 | 59 |
| $Tg_1 - Tg_2$ (° C.) | | | 3 | 8 | 8 | 1 | 2 | 3 | 28 | 33 | 6 | 21 | 1 |
| Miscibility (Presence or absence of turbidity) | $(Tg_1 + 30)$ ° C. | | Good | Excellent | Excellent | Good | Good | Excellent | Poor | Poor | — | Poor | Good |
| | Tp ° C. | | — | — | — | — | — | — | — | — | Excellent | — | — |
| $\lvert SP_{a1} - SP_B \rvert$ | | | 1.5 | 1.6 | 1.8 | 2.0 | 1.9 | 1.7 | 1.8 | 1.8 | 1.1 | 1.0 | 0.2 |
| $\lvert SP_{a2} - SP_B \rvert$ | | | 1.9 | 2.6 | 1.9 | 2.6 | 2.4 | 2.2 | 1.7 | — | 2.4 | — | — |
| $\lvert SP_A - SP_B \rvert$ | | | 1.6 | 1.7 | 1.9 | 1.9 | 2.0 | 1.8 | 1.9 | 1.8 | 1.2 | 1.0 | 0.2 |
| Value of right-hand side of equation (5) | | | 1.3 | — | — | — | — | 1.5 | — | — | — | 1.6 | 1.5 |
| Value of right-hand side of equation (6) | | | — | 1.7 | 1.9 | 1.9 | — | — | 1.9 | 1.9 | 1.9 | — | — |
| Value of right-hand side of equation (7) | | | — | — | — | — | 1.8 | — | — | — | — | — | — |
| Volume average particle size (μm) | | | 8 | 8 | 8 | 8 | 8 | 8 | 8 | 8 | 8 | 8 | 8 |
| Particle size distribution | | | 1.2 | 1.2 | 1.2 | 1.2 | 1.2 | 1.2 | 1.2 | 1.2 | 1.2 | 1.2 | 1.2 |

First, a Henschel mixer (FM10B available from Nippon Coke & Engineering Co., Ltd.) was used to pre-mix all the materials except for the fluidizing agent (F-1), and the mixture was kneaded by a twin screw kneader (PCM-30 available from Ikegai Group).

Subsequently, the kneaded mixture was ground into small particles by a supersonic jet mill (Labojet available from Nippon Pneumatic Mfg. Co., Ltd.), and the particles were classified by an air classifier (MDS-I available from Nippon Pneumatic Mfg. Co., Ltd.) to obtain toner particles having a volume average particle size D50 of 8 μm.

Further, the toner particles (100 parts) were mixed with the fluidizing agent (F-1) (0.5 parts) by a sample mill, whereby a toner was obtained.

$S_1$ and $S_2$ (endothermic peak areas during heating) of the toner binder were measured as described below, wherein $S_1$ was the area of the endothermic peak derived from the crystalline resin (A) in the first heating process and $S_2$ was the area of the endothermic peak derived from the crystalline resin (A) in the second heating process, which were measured by a DSC, when the toner binder was heated, cooled, and heated.

About 5 mg of each mixture obtained by mixing the crystalline resin (A) and the resin (B) at ratios shown in Tables 1 and 2 was accurately weighed, placed in an aluminium pan, and measured by a DSC under the following heating conditions.

Device: Q Series Version 2.8.0.394 (available from TA Instruments)

The toner binder was heated from 20° C. to 180° C. at a rate of 10° C./min (first heating process). After leaving to stand at 180° C. for 10 minutes, the toner binder was cooled to 0° C. at a rate of 10° C./min (first cooling process). After leaving to stand at 0° C. for 10 minutes, the toner binder was heated to 180° C. at a rate of 10° C./min (second heating process).

The toner binder was measured by a DSC from the beginning of the first heating process (20° C.) to the end of the second heating process (180° C.)

Tables 1 and 2 show values obtained by $(S_2/S_1)\times 100$. Tables 1 and 2 also show the endothermic capacities (J/g) derived from the crystalline resin (A) in the second heating process as measured by a DSC as the "(A)-derived endothermic capacity (J)/g".

In Tables 1 and 2, $T_{g1}$ indicates the glass transition temperature (Tg) of the resin (B) used to produce toner. $Tg_2$ indicates the glass transition temperature $Tg_2$ (° C.) derived from the resin (B) in a mixture of the crystalline resin (A) and the resin (B) at ratios shown in Tables 1 and 2. $Tg_2$ was measured in the same manner as for the Tg of the resin (B) ($Tg_1$).

Tables 1 and 2 show $Tg_2$ and $(Tg_1-Tg_2)$ measured as described above.

The miscibility of the mixtures obtained by mixing the crystalline resin (A) and the resin (B) at ratios shown in Tables 1 and 2 were evaluated as follows. Tables 1 and 2 show the results.

When the glass transition temperature $Tg_1$ of the resin (B) plus 30 degrees (° C.) was higher than temperature Tp (° C.) of the top of the endothermic peak derived from the crystalline resin (A), whether the mixture was wholly or partially turbid was visually observed at the temperature of $Tg_1$ plus 30 degrees (° C.). When the temperature of $Tg_1$ plus 30 degrees was lower than the temperature Tp, whether the mixture was wholly or partially turbid was visually observed at the temperature Tp.

[Criteria for Miscibility]

Excellent: Partially turbid

Good: Wholly turbid

Poor: Transparent

[Evaluation Method]

The following describes measurement methods, evaluation methods, and criteria for testing of the each obtained toner for low-temperature fixability, gloss, hot offset resistance, flowability, heat-resistant storage stability, electrostatic stability, grindability, image strength, folding resistance, and document offset.

<Low-Temperature Fixability>

The toner was uniformly placed on paper to a thickness of 0.6 mg/cm$^2$. At this point, the powder was placed on the paper using a printer from which a thermal fixing device was removed. Any method may be used as long as the powder can be uniformly placed at the above weight density.

The low-temperature fixing temperature at which cold offset occurred was measured when this paper was passed between a pressure roller and a heating roller at a fixing rate (peripheral speed of the heating roller) of 213 mm/sec and a fixing pressure (pressure by the pressure roller) of 10 kg/cm$^2$.

If the low-temperature fixing temperature is lower, it indicates that the toner has better low-temperature fixability. Tables 3 and 4 show the low-temperature fixing temperature (° C.) of the toner as the low-temperature fixability (° C.).

<Gloss>

The toner was fixed on paper in the same manner as for the evaluation of the low-temperature fixability. Then, thick white paper was placed under an image, and the degree of gloss of the printed image was measured at an incident angle of 60 degrees using a glossmeter ("IG-330" available from Horiba, Ltd.).

[Criteria]

Excellent: 20 or more

Good: 15 or more and less than 20

Average: 10 or more and less than 15

Poor: Less than 10

<Hot Offset Resistance (Hot Offset Occurring Temperature)>

The toner was fixed on paper in the same manner as for the evaluation of the low-temperature fixability. The fixed image was visually observed for whether or not hot offset occurred.

The hot offset occurring temperature after the paper passed between the pressure roller and the heating roller was regarded at the hot offset resistance (° C.).

<Flowability>

The bulk density (g/100 mL) of the toner was measured by a powder tester available from Hosokawa Micron Corporation, and the flowability was evaluated according to the following criteria. The range of "Average" or better (30 g/100 mL or more) is a practical range.

[Criteria]

Excellent: 36 or more

Good: 33 or more and less than 36

Average: 30 or more and less than 33

Below average: 27 or more and less than 30

Poor: Less than 27

<Heat-Resistant Storage Stability>

The toner was left to stand in an atmosphere of 50° C. for 24 hours. The degree of blocking was visually observed, and the heat-resistant storage stability was evaluated according to the following criteria.

[Criteria]

Good: No blocking occurred.

Poor: Blocking occurred.

<Electrostatic Stability>

(1) The toner (0.5 g) and ferrite carrier (F-150 available from Powdertech Co., Ltd.) (20 g) were placed in a 50-mL glass jar. The temperature and the relative humidity inside the glass jar were controlled at 23° C. and 50% for at least 8 hours.

(2) The glass jar was friction-stirred at 50 rpm for 10 minutes for 60 minutes by a Turbula shaker-mixer. The amount of electrostatic charge was measured for each time period.

A blow-off electrostatic charge meter (available from Toshiba Chemical Corporation) was used for measurement.

A value of "(Amount of electrostatic charge after 60 minutes of friction)/(Amount of electrostatic charge after 10 minutes of friction)" was calculated, and the value was regarded as an index of electrostatic stability.

[Criteria]

Excellent: 0.8 or more

Good: 0.7 or more and less than 0.8

Average: 0.6 or more and less than 0.7

Poor: Less than 0.6

<Grindability>

The toner was kneaded by a twin screw kneader and cooled to obtain coarsely ground particles (8.6 mesh pass to 30 mesh on). These particles were ground by a supersonic jet mill (Labojet available from Nippon Pneumatic Mfg. Co., Ltd.) under the following conditions.

Grinding pressure: 0.5 MPa

Grinding time: 10 minutes

Adjuster ring: 15 mm

Louver size: medium

Without classification, these particles were measured for the volume average particle size (μm) by a Coulter counter "TAII" (available from U.S. Coulter Electronics Ltd.). The grindability was evaluated according to the following criteria.

[Criteria]

Excellent: Less than 10

Good: 10 or more and less than 11

Average: 11 or more and less than 12

Poor: 12 or more

<Image Strength>

The test paper used to measure the low-temperature fixing temperature (i.e., the paper with a fixed image obtained to evaluate the low-temperature fixability) was subjected to a scratch test under a load of 10 g applied to a pencil fixed at a tilt of 45 degrees from directly above the pencil according to JIS K 5600. The image strength was evaluated based on the hardness of the pencil that did not scratch the image.

Higher pencil hardness indicates better image strength.

<Folding Resistance>

The test paper used to measure the low-temperature fixing temperature was folded with the image-fixed surface facing inward, and the paper was rubbed back and forth for 5 times under a load of 30 g.

The paper was unfolded and visually observed for the presence or absence of a white line formed on the image from folding.

[Criteria]

Good: No white lines are observed.

Average: A few white lines are observed.

Poor: White lines are observed.

<Document Offset Resistance>

Two sheets of the A4 paper with a fixed image obtained to evaluate the low-temperature fixability were stacked with the fixed images facing each other, and were left to stand at 65° C. under a load of 420 g (0.68 g/cm$^2$) for 10 minutes.

The document offset resistance was evaluated based on the following criteria from the condition when the stacked sheets of the paper were separated from each other.

[Criteria]

Good: No resistance

Average: A crunchy sound is heard, but the image is not peeled from the paper.

Poor: The image is peeled from the paper.

Tables 3 and 4 show the evaluation results.

TABLE 3

| | | Example | | | | | |
|---|---|---|---|---|---|---|---|
| | | 1 | 2 | 3 | 4 | 5 | 6 |
| Results of properties | Low-temperature fixability (° C.) | 100 | 100 | 110 | 105 | 105 | 110 |
| | Gloss | Excellent | Excellent | Good | Good | Good | Good |
| | Hot offset resistance (° C.) | 210 | 210 | 200 | 200 | 200 | 200 |
| | Flowability | Excellent | Excellent | Good | Good | Good | Excellent |
| | Heat-resistant storage stability | Good | Good | Good | Good | Good | Good |
| | Electrostatic stability | Excellent | Excellent | Good | Excellent | Excellent | Excellent |
| | Grindability | Excellent | Excellent | Excellent | Excellent | Excellent | Excellent |
| | Image strength | 2H | 2H | H | 2H | 2H | H |
| | Folding resistance | Good | Good | Good | Good | Good | Good |
| | Document offset resistance | Good | Good | Good | Good | Good | Good |

| | | Example | | | | | |
|---|---|---|---|---|---|---|---|
| | | 7 | 8 | 9 | 10 | 11 | 12 |
| Results of properties | Low-temperature fixability (° C.) | 100 | 100 | 110 | 110 | 110 | 110 |
| | Gloss | Excellent | Excellent | Excellent | Excellent | Excellent | Good |
| | Hot offset resistance (° C.) | 200 | 200 | 200 | 200 | 200 | 200 |
| | Flowability | Excellent | Excellent | Excellent | Excellent | Excellent | Good |
| | Heat-resistant storage stability | Good | Good | Good | Good | Good | Good |
| | Electrostatic stability | Excellent | Excellent | Excellent | Excellent | Excellent | Good |
| | Grindability | Excellent | Excellent | Excellent | Excellent | Excellent | Excellent |
| | Image strength | 2H | 2H | 2H | 2H | 2H | 2H |
| | Folding resistance | Good | Good | Good | Good | Good | Good |
| | Document offset resistance | Good | Good | Good | Good | Good | Good |

TABLE 4

| | | Example | | | | | | Comparative Example | | | | |
|---|---|---|---|---|---|---|---|---|---|---|---|---|
| | | 13 | 14 | 15 | 16 | 17 | 18 | 1 | 2 | 3 | 4 | 5 |
| Results of properties | Low-temperature fixability (° C.) | 115 | 105 | 130 | 105 | 100 | 100 | 140 | 130 | 140 | 130 | 150 |
| | Gloss | Excellent | Excellent | Good | Excellent | Excellent | Excellent | Poor | Good | Poor | Good | Poor |
| | Hot offset resistance (° C.) | 200 | 210 | 220 | 200 | 200 | 200 | 180 | 180 | 190 | 180 | 200 |
| | Flowability | Excellent | Excellent | Good | Excellent | Excellent | Excellent | Poor | Poor | Average | Average | Good |
| | Heat-resistant storage stability | Good | Good | Good | Good | Good | Good | Poor | Poor | Good | Poor | Good |
| | Electrostatic stability | Excellent | Excellent | Good | Excellent | Excellent | Excellent | Poor | Poor | Poor | Good | Good |

TABLE 4-continued

| | Example | | | | | | Comparative Example | | | | |
|---|---|---|---|---|---|---|---|---|---|---|---|
| | 13 | 14 | 15 | 16 | 17 | 18 | 1 | 2 | 3 | 4 | 5 |
| Grindability | Excellent | Excellent | Good | Excellent | Excellent | Excellent | Poor | Average | Poor | Good | Good |
| Image strength | 2H | 2H | H | 2H | 2H | 2H | 3B | 2B | HB | 2B | 2B |
| Folding resistance | Good | Good | Good | Good | Good | Good | Poor | Poor | Average | Poor | Poor |
| Document offset resistance | Good | Good | Good | Good | Good | Good | Poor | Poor | Good | Poor | Poor |

As is clear from the evaluation results shown in Tables 3 and 4, the toner in each of Examples 1 to 18 of the present invention was excellent in all the properties. In contrast, the toner in each of Comparative Examples 1, 2, and 4 in which the equation (1) was not satisfied was poor in heat-resistant storage stability and some other properties. In particular, in Comparative Examples 2 and 4, the equation (1) could not be satisfied due to the absence of the segment (a2).

In addition, in Comparative Example 3 in which the temperature Tp of the crystalline resin (A) was excessively high, the toner was poor in properties such as low-temperature fixability. In addition, in Comparative Example 5 in which the styrene acrylic resin (the resin (B')) was used, the toner was particularly poor in properties such as low-temperature fixability and gloss.

INDUSTRIAL APPLICABILITY

The toner of the present invention has excellent flowability, heat-resistant storage stability, electrostatic stability, grindability, image strength, and folding resistance while maintaining the balance among hot offset resistance, low-temperature fixability, and gloss. The toner is useful as a toner for electrostatic image development for use in electrography, electrostatic recording, electrostatic printing, or the like.

The invention claimed is:

1. A toner binder comprising:

a crystalline resin (A); and a resin (B) that is a polyester resin or its modified resin, the polyester resin being obtained by reaction of an alcohol component (X) and a carboxylic acid component (Y) as raw materials, wherein the crystalline resin (A) is a resin having at least two chemically bonded segments including a crystalline segment (a1) miscible with the resin (B) and a segment (a2) immiscible with the resin (B), wherein the segment (a1) has a structure formed of a crystalline polyester (a11), and the crystalline polyester (a11) is obtained by reaction of a diol component (x) and a dicarboxylic acid component (y) as raw materials, wherein the diol component (x) has a C2-36 linear aliphatic diol content of 80% by mole or more, wherein the dicarboxylic acid component (y) comprises a C2-C50, which includes a carbon atom of a carbonyl group, alkane dicarboxylic acid and/or a C4-C50 alkene dicarboxylic acid, wherein the segment (a2) immiscible with the resin (B) has a structure formed of a C18-C42 long-chain alkyl monoalcohol, a C18-C42 long-chain alkyl monocarboxylic acid, hydroxyl-terminated polybutadiene or hydroxyl-terminated dimethylsilicone, and wherein the alcohol component (X) comprises a bisphenol A polyoxyalkylene ether, the number of alkylene oxide units in the bisphenol A polyoxyalkylene ether is 2 to 5, and the alkylene oxide is ethylene oxide, propylene oxide or a combination of ethylene oxide and propylene oxide, wherein a temperature (Tp) of a top of an endothermic peak derived from the crystalline resin (A) as measured by a differential scanning calorimeter (DSC) is in the range of 40° C. to 100° C., and endothermic peak areas $S_1$ and $S_2$ during heating satisfy the following equation:

$$(S_2/S_1)\times 100 \geq 35 \quad (1)$$

wherein $S_1$ is an area of the endothermic peak derived from the crystalline resin (A) in the first heating process, and $S_2$ is an area of the endothermic peak derived from the crystalline resin (A) in the second heating process, when the toner binder is heated, cooled, and heated.

2. The toner binder according to claim 1, wherein an endothermic capacity derived from the crystalline resin (A) in the second heating process is 1 to 30 J/g.

3. The toner binder according to claim 1, wherein the glass transition temperature $Tg_1$ (° C.) of the resin (B) and the glass transition temperature $Tg_2$ (° C.) derived from the resin (B) in a mixture obtained by adding the crystalline resin (A) to the resin (B) satisfy the following equation (2):

$$Tg_1 - Tg_2 \leq 15 \quad (2).$$

4. The toner binder according to claim 1, wherein the weight ratio (B)/(A) of the resin (B) to the crystalline resin (A) is in the range of 50/50 to 95/5.

5. The toner binder according to claim 1, wherein when the glass transition temperature $Tg_1$ of the resin (B) plus 30 degrees (° C.) is higher than the temperature Tp (° C.) of the top of the endothermic peak derived from the crystalline resin (A), the toner binder is wholly or partially turbid at the temperature of $Tg_1$ plus 30 degrees, and when the temperature of $Tg_1$ plus 30 degrees is lower than the temperature Tp, the toner binder is wholly or partially turbid at the temperature Tp.

6. The toner binder according to claim 1, wherein the segment (a1) and the segment (a2) satisfy both the following equations (3) and (4):

$$|SP_{a1} - SP_B| \leq 1.9 \quad (3)$$

$$|SP_{a2} - SP_B| 1.9 \quad (4)$$

wherein $SP_{a1}$ is the SP value of the segment (a1), $SP_{a2}$ is the SP value of the segment (a2), and $SP_B$ is the SP value of the resin (B).

7. The toner binder according to claim 1, wherein the segment (a1) and the segment (a2) in the crystalline resin (A) are bonded through at least one functional group selected from the group consisting of an ester group, a urethane group, a urea group, an amide group, and an epoxy group.

8. The toner binder according to claim 1, wherein the resin (B) has an acid value of 30 mg KOH/g or less.

9. The toner binder according to claim 1, wherein the resin (B) has a hydroxyl value of 30 mg KOH/g or less.

10. The toner binder according to claim 1, wherein when the molecular weight of the resin (B) as measured by gel permeation chromatography is expressed as the peak area, the amount of molecules having a molecular weight of 1,000 or less in the resin (B) is 10% or less of the total peak area.

11. The toner binder according to claim 1, wherein the resin (B) is a polyester resin (B11) obtained by reaction of the alcohol component (X) containing an aromatic diol (x1) in an amount of 80% by mole or more and the carboxylic acid component (Y) as raw materials, and the following equation (5) is satisfied:

$$|SP_A-SP_B|\geq 0.0050\times(AV_B+OHV_B)+1.258 \quad (5)$$

wherein $SP_A$ is the SP value of the crystalline resin (A), $SP_B$ is the SP value of the resin (B), $AV_B$ is the acid value of the resin (B), and $OHV_B$ is the hydroxyl value of the resin (B).

12. The toner binder according to claim 1, wherein the resin (B) is a polyester resin (B12) obtained by reaction of the alcohol component (X) containing a C2-C10 aliphatic alcohol (x2) in an amount of 80% by mole or more and the carboxylic acid component (Y) as raw materials, and the following equation (6) is satisfied:

$$|SP_A-SP_B|\geq 1.9 \quad (6)$$

wherein $SP_A$ is the SP value of the crystalline resin (A), and $SP_B$ is the SP value of the resin (B).

13. The toner binder according to claim 1, wherein the resin (B) is a polyester resin (B13) obtained by reaction of the alcohol component (X) and the carboxylic acid component (Y) as raw materials, wherein the alcohol component (X) contains the aromatic diol (x1) and the C2-C10 aliphatic alcohol (x2) at a molar ratio of 20/80 to 80/20, and the following equation (7) is satisfied:

$$|SP_A-SP_B|\geq 0.0117\times(AV_B+OHV_B)+1.287 \quad (7)$$

wherein $SP_A$ is the SP value of the crystalline resin (A), $SP_B$ is the SP value of the resin (B), $AV_B$ is the acid value of the resin (B), and $OHV_B$ is the hydroxyl value of the resin (B).

14. The toner binder according to claim 1, wherein the crystalline resin (A) contains at least one selected from the group consisting of an ester group, a urethane group, a urea group, an amide group, an epoxy group, and a vinyl group.

15. The toner binder according to claim 1, wherein the modified resin of the polyester resin is one obtained by modifying the polyester resin by at least one selected from the group consisting of a urethane group, a urea group, an amide group, an epoxy group, and a vinyl group.

16. A toner comprising:

the toner binder according to claim 1; and a colorant.

* * * * *